US011655573B2

(12) United States Patent
Barnholtz et al.

(10) Patent No.: US 11,655,573 B2
(45) Date of Patent: May 23, 2023

(54) FIBROUS STRUCTURES AND METHODS FOR MAKING SAME

(71) Applicant: The Procter & Gamble Company, Cincinnati, OH (US)

(72) Inventors: Steven Lee Barnholtz, West Chester, OH (US); Michael Donald Suer, Colerain Township, OH (US); Christopher Michael Young, Loveland, OH (US); Paul Dennis Trokhan, Hamilton, OH (US); Mattias Schmidt, Idstein (DE)

(73) Assignee: The Procter & Gamble Company, Cincinnati, OH (US)

( * ) Notice: Subject to any disclaimer, the term of this patent is extended or adjusted under 35 U.S.C. 154(b) by 270 days.

(21) Appl. No.: 13/889,415

(22) Filed: May 8, 2013

(65) Prior Publication Data

US 2013/0302566 A1 Nov. 14, 2013

Related U.S. Application Data

(60) Provisional application No. 61/644,091, filed on May 8, 2012.

(51) Int. Cl.

| | |
|---|---|
| ***D04H 1/72*** | (2012.01) |
| ***D21H 27/00*** | (2006.01) |
| ***D21H 15/06*** | (2006.01) |
| ***D21H 27/30*** | (2006.01) |
| ***A47K 10/02*** | (2006.01) |

(Continued)

(52) U.S. Cl.

CPC ..... *D04H 1/72* (2013.01); *A47K 10/02* (2013.01); *A47K 10/16* (2013.01); *D21H 15/06* (2013.01); *D21H 27/005* (2013.01); *D21H 27/30* (2013.01); *A47K 2010/322* (2013.01); *Y10T 428/24446* (2015.01); *Y10T 428/24694* (2015.01); *Y10T 442/184* (2015.04); *Y10T 442/659* (2015.04); *Y10T 442/664* (2015.04)

(58) Field of Classification Search

CPC . B32B 5/26; D04H 1/72; A47K 10/02; A47K 10/16; A47K 2010/322; D21H 15/06; D21H 27/005; D21H 27/30; Y10T 428/24446; Y10T 428/24694; Y10T 442/184; Y10T 442/659; Y10T 442/664

USPC ..... 428/152

See application file for complete search history.

(56) References Cited

U.S. PATENT DOCUMENTS 4,469,735 A * 9/1984 Trokhan ..... 428/154
5,139,841 A * 8/1992 Makoui ..... A61F 13/15699 156/273.7

(Continued)

FOREIGN PATENT DOCUMENTS

RU 2339353 C2 11/2008

OTHER PUBLICATIONS

International Search Report dated Jul. 24, 2013.

(Continued)

*Primary Examiner* — Alicia J Sawdon
*Assistant Examiner* — Laura B Figg
(74) *Attorney, Agent, or Firm* — C. Brant Cook

(57) ABSTRACT

Novel fibrous structures that contain filaments, and optionally, solid additives, such as fibers, for example wood pulp fibers, sanitary tissue products comprising such fibrous structures, and methods for making such fibrous structures and/or sanitary tissue products are provided.

18 Claims, 12 Drawing Sheets

(51) Int. Cl.
*A47K 10/16* (2006.01)
*A47K 10/32* (2006.01)

(56) References Cited

U.S. PATENT DOCUMENTS 5,580,423 A * 12/1996 Ampulski ..... D21F 11/006 162/117
5,672,415 A * 9/1997 Sawyer ..... D01F 8/06 428/219
5,685,954 A * 11/1997 Marinack et al. ..... 162/112
5,885,417 A * 3/1999 Marinack et al. ..... 162/111
6,150,002 A 11/2000 Varona
7,176,150 B2 2/2007 Kopacz et al.
2003/0211802 A1 11/2003 Keck et al.
2005/0148260 A1 7/2005 Kopacz et al.
2005/0148264 A1 7/2005 Varona et al.
2007/0207293 A1* 9/2007 Santiago ..... D21H 27/02 428/174
2009/0022960 A1* 1/2009 Suer ..... A47K 10/16 428/194
2009/0084513 A1 4/2009 Barnholtz et al.
2009/0233049 A1 9/2009 Jackson et al.
2011/0104444 A1* 5/2011 Barnholtz ..... D04H 1/407 428/156
2011/0209840 A1 9/2011 Barnholtz et al.
2012/0066855 A1 3/2012 Schmidt et al.

OTHER PUBLICATIONS

Human Eye, Handbook of Optical Systems: vol. 4 Survey of Optical Instruments, 4 Pages.
Miller et al., "Liquid Porosimetry: New Methodology and Applications", Journal of Colloid and Interface Science, 1994, pp. 163-170.
Third Party Opposition filed for European Patent Application Ser. No. 13723381.3, dated Mar. 28, 2018; 26 pages.

* cited by examiner

FIBROUS STRUCTURES AND METHODS FOR MAKING SAME

FIELD OF THE INVENTION

The present invention relates to fibrous structures and more particularly to fibrous structures that comprise filaments, and optionally solid additives, such as fibers, for example wood pulp fibers, sanitary tissue products comprising such fibrous structures, and methods for making such fibrous structures and/or sanitary tissue products.

BACKGROUND OF THE INVENTION

Consumers of fibrous structures, especially paper towels, desire improved absorbency properties (such as absorption capacity, rate of absorption, and/or surface drying properties) in their fibrous structures. The pore volume distribution present in fibrous structures impacts the absorbency properties of the fibrous structures. In the past, some fibrous structures exhibit pore volume distributions that optimize the absorption capacity others exhibit pore volume distributions that optimize the rate of absorption. To date, no known fibrous structures balance the properties of absorption capacity with rate of absorption and surface drying via tailoring the pore volume distribution exhibited by the fibrous structures.

Known fibrous structures exhibit various pore volume distributions. For example, a currently marketed non-filament-containing, wet-laid, wood pulp fiber-based paper towel exhibits a substantially uniform pore volume distribution. In another example, less than 17% of the total pore volume present in a currently marketed, filament-containing wipe product exists in radii of from 91 μm to 140 μm and 13.8% of the total pore volume exists in radii of from 2.5 μm to 50 μm. In yet another example, a currently marketed, single-ply non-textile washcloth exhibits a pore volume distribution where 0.4% of the total pore volume present in the fibrous structures exists in pores of radii of from 2.5 μm to 50 μm as measured by the Pore Volume Distribution Test Method described herein. In yet another example, a currently marketed, hydroentangled spunbond/wood pulp fibers and filament-containing single-ply paper towel product fails to meet the needs of consumers.

The problem faced by formulators is how to produce fibrous structures that have a pore volume distribution that balances the absorbency properties (i.e., absorption capacity and rate of absorption and surface drying) that satisfies the consumers' needs.

Accordingly, there is a need for fibrous structures that exhibit 1) a pore volume distribution such that greater than 8% of the total pore volume present in the fibrous structures exists in pores of radii of from 2.5 μm to 50 μm as measured by the Pore Volume Distribution Test Method described herein and/or 2) a sled surface drying time of less than 50 seconds as measured by the Sled Surface Drying Test Method described herein, sanitary tissue products comprising such fibrous structure, and methods for making such fibrous structures and/or sanitary tissue products.

SUMMARY OF THE INVENTION

The present invention solves the problem identified above by fulfilling the needs of the consumers by providing fibrous structures comprising filaments, and optionally solid additives, such as fibers, for example wood pulp fibers that exhibit a novel pore volume distribution as measured by the Pore Volume Distribution Test Method described herein and/or a novel sled surface drying time as measured by the Sled Surface Drying Test Method described herein and methods for making such fibrous structures.

A solution to the problem identified above is a fibrous structure, such as a multi-ply fibrous structure, comprising filaments and optionally solid additives, wherein the fibrous structure is formed such that the fibrous structure exhibits 1) a pore volume distribution such that greater than 8% of the total pore volume present in the fibrous structures exists in pores of radii of from 2.5 μm to 50 μm as measured by the Pore Volume Distribution Test Method described herein and/or 2) a sled surface drying time of less than 50 seconds as measured by the Sled Surface Drying Test Method described herein.

In one example of the present invention, a multi-ply fibrous structure comprising a plurality of filaments, wherein the fibrous structure exhibits a pore volume distribution such that greater than 8% of the total pore volume present in the fibrous structure exists in pores in radii of from 2.5 μm to 50 μm, is provided.

In another example of the present invention, a fibrous structure comprising a plurality of filaments, wherein the fibrous structure comprises a first region and a second region, wherein the first and second regions exhibit different densities and wherein the fibrous structure exhibits a pore volume distribution such that greater than 8% of the total pore volume present in the fibrous structure exists in pores of radii of from 2.5 μm to 50 μm, is provided.

In still another example of the present invention, a single ply fibrous structure comprising a plurality of filaments, wherein the fibrous structure exhibits a pore volume distribution such that greater than 8% of the total pore volume present in the fibrous structure exists in pores in radii of from 2.5 μm to 50 μm and greater than 17% of the total pore volume present in the fibrous structure exists in pores in radii of from 91 μm to 140 μm, is provided.

In yet another example of the present invention, a multi-ply fibrous structure comprising a plurality of filaments, wherein the fibrous structure exhibits a sled surface drying time of less than 50 seconds as measured according to the Sled Surface Drying Test Method, is provided.

In even another example of the present invention, a dry fibrous structure comprising a plurality of filaments, wherein the fibrous structure exhibits a sled surface drying time of less than 50 seconds as measured according to the Sled Surface Drying Test Method and a VFS of greater than 6 g/g, is provided.

In even yet another example of the present invention, a foreshortened fibrous structure comprising a plurality of filaments, wherein the fibrous structure exhibits a sled surface drying time of less than 50 seconds as measured according to the Sled Surface Drying Test Method, is provided.

In still yet another example of the present invention, a foreshortened and/or creped multi-ply fibrous structure comprising a plurality of filaments and a plurality of solid additives, is provided.

In yet another example of the present invention, a method for making a fibrous structure comprising the steps of:

a. providing a first fibrous structure comprising a plurality of filaments and a plurality of solid additives;

b. imparting a three-dimensional texture to the first fibrous structure such that the first fibrous structure exhibits differential density; and c. optionally combining the first fibrous structure with a second fibrous structure to form a multi-ply fibrous structure, for example a multi-ply fibrous structure according to the present invention, is provided.

In yet another example of the present invention, a sanitary tissue product comprising a fibrous structure according to the present invention is provided.

Accordingly, the present invention provides fibrous structures that solve the problems described above by providing fibrous structures that exhibit 1) a pore volume distribution such that greater than 8% of the total pore volume present in the fibrous structures exists in pores of radii of from 2.5 μm to 50 μm as measured by the Pore Volume Distribution Test Method described herein and/or 2) a sled surface drying time of less than 50 seconds as measured by the Sled Surface Drying Test Method described herein, sanitary tissue products comprising such fibrous structures, and methods for making such fibrous structures.

BRIEF DESCRIPTION OF THE DRAWINGS

FIG. 13A is a cross-sectional view of FIG. 13;

FIG. 14A is a cross-sectional view of FIG. 14.

DETAILED DESCRIPTION OF THE INVENTION

Definitions

Figure 1:
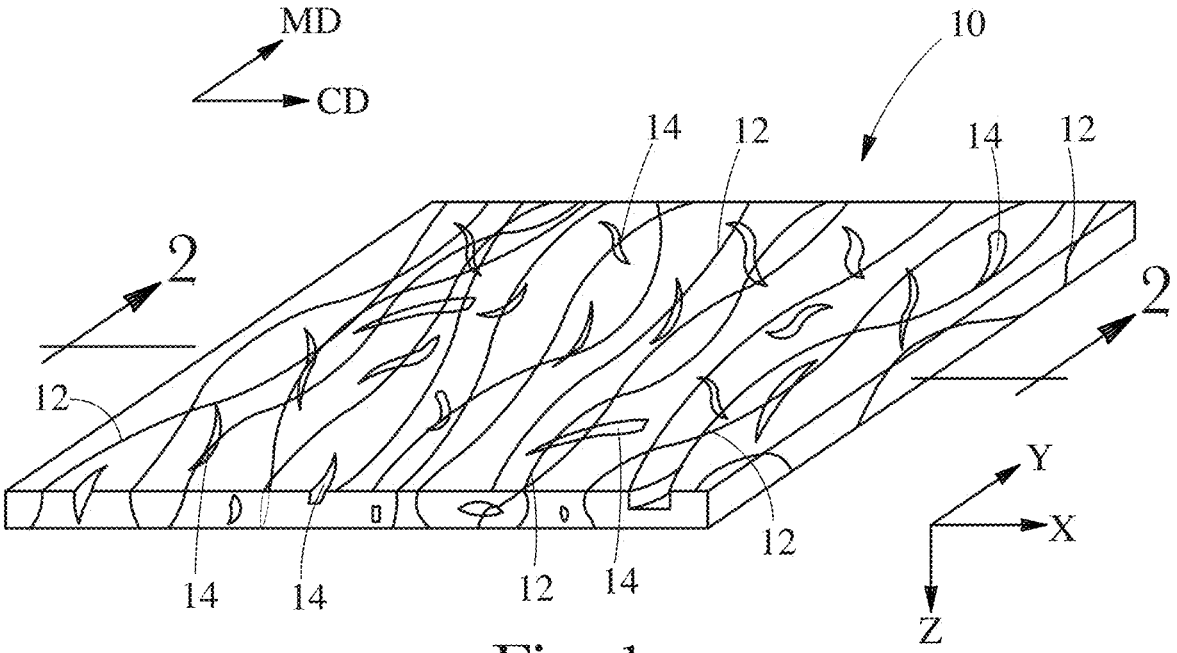
FIG. 1 is a schematic representation of an example of a fibrous structure according to the present invention.

"Fibrous structure" as used herein means a structure that comprises one or more filaments and optionally one or more solid additives, such as one or more fibers. In one example, a fibrous structure according to the present invention means an orderly arrangement of filaments and optionally fibers within a structure in order to perform a function. In another example, a fibrous structure according to the present invention is a nonwoven.

Non-limiting examples of processes for making fibrous structures include known wet-laid papermaking processes and air-laid papermaking processes, and meltblowing and/or spunbonding processes. In one example, the fibrous structures of the present invention are made via a process comprising meltblowing.

The fibrous structures of the present invention may be homogeneous or may be layered. If layered, the fibrous structures may comprise at least two and/or at least three and/or at least four and/or at least five layers.

The fibrous structures of the present invention may be co-formed fibrous structures.

"Co-formed fibrous structure" as used herein means that the fibrous structure comprises a mixture of at least two different materials wherein at least one of the materials comprises a filament, such as a polypropylene filament, and at least one other material, different from the first material, comprises a solid additive, such as a fiber and/or a particulate. In one example, a co-formed fibrous structure comprises solid additives, such as fibers, such as wood pulp fibers and/or absorbent gel materials and/or filler particles and/or particulate spot bonding powders and/or clays, and filaments, such as polypropylene filaments.

"Solid additive" as used herein means a fiber and/or a particulate.

"Particulate" as used herein means a granular substance or powder.

"Fiber" and/or "Filament" as used herein means an elongate particulate having an apparent length greatly exceeding its apparent width, i.e. a length to diameter ratio of at least about 10. For purposes of the present invention, a "fiber" is an elongate particulate as described above that exhibits a length of less than 5.08 cm (2 in.) and a "filament" is an elongate particulate as described above that exhibits a length of greater than or equal to 5.08 cm (2 in.).

Fibers are typically considered discontinuous in nature. Non-limiting examples of fibers include wood pulp fibers and synthetic staple fibers such as polyester fibers.

Filaments are typically considered continuous or substantially continuous in nature. Filaments are relatively longer than fibers. Non-limiting examples of filaments include meltblown and/or spunbond filaments. Non-limiting examples of materials that can be spun into filaments include natural polymers, such as starch, starch derivatives, cellulose and cellulose derivatives, hemicellulose, hemicellulose derivatives, chitin, chitosan, polyisoprene (cis and trans), peptides, polyhydroxyalkanoates, and synthetic polymers including, but not limited to, thermoplastic polymer filaments comprising thermoplastic polymers, such as polyesters, nylons, polyolefins such as polypropylene filaments, polyethylene filaments, polyvinyl alcohol and polyvinyl alcohol derivatives, sodium polyacrylate (absorbent gel material) filaments, and copolymers of polyolefins such as polyethylene-octene, and biodegradable or compostable thermoplastic fibers such as polylactic acid filaments, polyvinyl alcohol filaments, and polycaprolactone filaments. In one example, the filament comprises a thermoplastic polymer selected from the group consisting of: polypropylene, polyethylene, polyester, polylactic acid, polyhydroxyalkanoate, polyvinyl alcohol, polycaprolactone, styrene-butadiene-styrene block copolymer, styrene-isoprene-styrene block copolymer, poly-urethane, and mixtures thereof. In another example, the filament comprises a thermoplastic polymer is selected from the group consisting of: polypropylene, polyethylene, polyester, polylactic acid, polyhydroxyalkanoate, polyvinyl alcohol, polycaprolactone, and mixtures thereof.

The filaments may be monocomponent or multicomponent, such as bicomponent filaments.

In one example, the filaments exhibits an average fiber diameter of less than 50 μm and/or less than 25 μm and/or less than 15 μm and/or less than 12 μm (also referred to as "microfilaments") and/or less than 10 μm and/or less than 6 μm.

In one example of the present invention, "fiber" refers to papermaking fibers. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified web. U.S. Pat. No. 4,300,981 and U.S. Pat. No. 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking In addition to the various wood pulp fibers, other fibers such as cotton linters, rayon, lyocell, trichomes, seed hairs, and bagasse can be used in this invention.

Other sources of cellulose in the form of fibers or capable of being spun into fibers include grasses and grain sources.

"Sanitary tissue product" as used herein means a soft, low density (i.e. <about 0.15 g/cm$^3$) web useful as a wiping implement for post-urinary and post-bowel movement cleaning (toilet tissue), for otorhinolaryngological discharges (facial tissue), and multi-functional absorbent and cleaning uses (absorbent towels). Non-limiting examples of suitable sanitary tissue products of the present invention include paper towels, bath tissue, facial tissue, napkins, baby wipes, adult wipes, wet wipes, cleaning wipes, polishing wipes, cosmetic wipes, car care wipes, wipes that comprise an active agent for performing a particular function, cleaning substrates for use with implements, such as a Swiffer® cleaning wipe/pad. The sanitary tissue product may be convolutedly wound upon itself about a core or without a core to form a sanitary tissue product roll.

In one example, the sanitary tissue product of the present invention comprises a fibrous structure according to the present invention.

The sanitary tissue products of the present invention may exhibit a basis weight between about 10 g/m$^2$ to about 120 g/m$^2$ and/or from about 15 g/m$^2$ to about 110 g/m$^2$ and/or from about 20 g/m$^2$ to about 100 g/m$^2$ and/or from about 30 to 90 g/m$^2$. In addition, the sanitary tissue product of the present invention may exhibit a basis weight between about 40 g/m$^2$ to about 120 g/m$^2$ and/or from about 50 g/m$^2$ to about 110 g/m$^2$ and/or from about 55 g/m$^2$ to about 105 g/m$^2$ and/or from about 60 to 100 g/m$^2$.

The sanitary tissue products of the present invention may exhibit a total dry tensile strength of at least 59 g/cm (150 g/in) and/or from about 78 g/cm (200 g/in) to about 394 g/cm (1000 g/in) and/or from about 98 g/cm (250 g/in) to about 335 g/cm (850 g/in). In addition, the sanitary tissue product of the present invention may exhibit a total dry tensile strength of at least 196 g/cm (500 g/in) and/or from about 196 g/cm (500 g/in) to about 394 g/cm (1000 g/in) and/or from about 216 g/cm (550 g/in) to about 335 g/cm (850 g/in) and/or from about 236 g/cm (600 g/in) to about 315 g/cm (800 g/in). In one example, the sanitary tissue product exhibits a total dry tensile strength of less than about 394 g/cm (1000 g/in) and/or less than about 335 g/cm (850 g/in).

In another example, the sanitary tissue products of the present invention may exhibit a total dry tensile strength of at least 196 g/cm (500 g/in) and/or at least 236 g/cm (600 g/in) and/or at least 276 g/cm (700 g/in) and/or at least 315 g/cm (800 g/in) and/or at least 354 g/cm (900 g/in) and/or at least 394 g/cm (1000 g/in) and/or from about 315 g/cm (800 g/in) to about 1968 g/cm (5000 g/in) and/or from about 354 g/cm (900 g/in) to about 1181 g/cm (3000 g/in) and/or from about 354 g/cm (900 g/in) to about 984 g/cm (2500 g/in) and/or from about 394 g/cm (1000 g/in) to about 787 g/cm (2000 g/in).

The sanitary tissue products of the present invention may exhibit an initial total wet tensile strength of less than about 78 g/cm (200 g/in) and/or less than about 59 g/cm (150 g/in) and/or less than about 39 g/cm (100 g/in) and/or less than about 29 g/cm (75 g/in).

The sanitary tissue products of the present invention may exhibit an initial total wet tensile strength of at least 118 g/cm (300 g/in) and/or at least 157 g/cm (400 g/in) and/or at least 196 g/cm (500 g/in) and/or at least 236 g/cm (600 g/in) and/or at least 276 g/cm (700 g/in) and/or at least 315 g/cm (800 g/in) and/or at least 354 g/cm (900 g/in) and/or at least 394 g/cm (1000 g/in) and/or from about 118 g/cm (300 g/in) to about 1968 g/cm (5000 g/in) and/or from about 157 g/cm (400 g/in) to about 1181 g/cm (3000 g/in) and/or from about 196 g/cm (500 g/in) to about 984 g/cm (2500 g/in) and/or from about 196 g/cm (500 g/in) to about 787 g/cm (2000 g/in) and/or from about 196 g/cm (500 g/in) to about 591 g/cm (1500 g/in).

The sanitary tissue products of the present invention may exhibit a density (measured at 95 g/in$^2$) of less than about 0.60 g/cm$^3$ and/or less than about 0.30 g/cm$^3$ and/or less than about 0.20 g/cm$^3$ and/or less than about 0.10 g/cm$^3$ and/or less than about 0.07 g/cm$^3$ and/or less than about 0.05 g/cm$^3$ and/or from about 0.01 g/cm$^3$ to about 0.20 g/cm$^3$ and/or from about 0.02 g/cm$^3$ to about 0.10 g/cm$^3$.

The sanitary tissue products of the present invention may be in the form of sanitary tissue product rolls. Such sanitary tissue product rolls may comprise a plurality of connected, but perforated sheets of fibrous structure, that are separably dispensable from adjacent sheets. In one example, one or more ends of the roll of sanitary tissue product may comprise an adhesive and/or dry strength agent to mitigate the loss of fibers, especially wood pulp fibers from the ends of the roll of sanitary tissue product.

The sanitary tissue products of the present invention may comprises additives such as softening agents, temporary wet strength agents, permanent wet strength agents, bulk softening agents, lotions, silicones, wetting agents, latexes, especially surface-pattern-applied latexes, dry strength agents such as carboxymethylcellulose and starch, and other types of additives suitable for inclusion in and/or on sanitary tissue products.

"Weight average molecular weight" as used herein means the weight average molecular weight as determined using gel permeation chromatography according to the protocol found in Colloids and Surfaces A. Physico Chemical & Engineering Aspects, Vol. 162, 2000, pg. 107-121.

"Basis Weight" as used herein is the weight per unit area of a sample reported in lbs/3000 $ft^2$ or $g/m^2$.

"Machine Direction" or "MD" as used herein means the direction parallel to the flow of the fibrous structure through the fibrous structure making machine and/or sanitary tissue product manufacturing equipment.

"Cross Machine Direction" or "CD" as used herein means the direction parallel to the width of the fibrous structure making machine and/or sanitary tissue product manufacturing equipment and perpendicular to the machine direction.

"Ply" as used herein means an individual, integral fibrous structure.

"Plies" as used herein means two or more individual, integral fibrous structures disposed in a substantially contiguous, face-to-face relationship with one another, forming a multi-ply fibrous structure and/or multi-ply sanitary tissue product. It is also contemplated that an individual, integral fibrous structure can effectively form a multi-ply fibrous structure, for example, by being folded on itself.

"Total Pore Volume" as used herein means the sum of the fluid holding void volume in each pore range from 1 μm to 1000 μm radii as measured according to the Pore Volume Test Method described herein.

"Pore Volume Distribution" as used herein means the distribution of fluid holding void volume as a function of pore radius. The Pore Volume Distribution of a fibrous structure is measured according to the Pore Volume Test Method described herein.

"Dry fibrous structure" as used herein means a fibrous structure that has been conditioned in a conditioned room at a temperature of 23° C.±1.0° C. and a relative humidity of 50%±2% for a minimum of 12 hours. In one example, a dry fibrous structure comprises less than 20% and/or less than 15% and/or less than 10% and/or less than 7% and/or less than 5% and/or less than 3% and/or to 0% and/or to greater than 0% based on the weight of the fibrous structure of moisture, such as water, for example free water. In another example, a dry fibrous structure as used herein means a fibrous structure that has been placed in a drying oven for 24 hours at 70° C. with a relative humidity of about 4%.

As used herein, the articles "a" and "an" when used herein, for example, "an anionic surfactant" or "a fiber" is understood to mean one or more of the material that is claimed or described.

All percentages and ratios are calculated by weight unless otherwise indicated. All percentages and ratios are calculated based on the total composition unless otherwise indicated.

Unless otherwise noted, all component or composition levels are in reference to the active level of that component or composition, and are exclusive of impurities, for example, residual solvents or by-products, which may be present in commercially available sources.

Fibrous Structure

It has surprisingly been found that the fibrous structures of the present invention exhibit a pore volume distribution unlike pore volume distributions of other known fibrous structures, for example other known structured and/or textured fibrous structures. As set forth below, references to fibrous structures of the present invention are also applicable to sanitary issue products comprising one or more fibrous structures of the present invention.

The fibrous structures of the present invention have surprisingly been found to exhibit improved absorbent capacity and surface drying. In one example, the fibrous structures comprise a plurality of filaments and a plurality of solid additives, for example fibers.

The fibrous structures of the present invention comprise a plurality of filaments and optionally, a plurality of solid additives, such as fibers.

The fibrous structures of the present invention may comprise any suitable amount of filaments and any suitable amount of solid additives. For example, the fibrous structures may comprise from about 10% to about 70% and/or from about 20% to about 60% and/or from about 30% to about 50% by dry weight of the fibrous structure of filaments and from about 90% to about 30% and/or from about 80% to about 40% and/or from about 70% to about 50% by dry weight of the fibrous structure of solid additives, such as wood pulp fibers.

The filaments and solid additives of the present invention may be present in fibrous structures according to the present invention at weight ratios of filaments to solid additives of from at least about 1:1 and/or at least about 1:1.5 and/or at least about 1:2 and/or at least about 1:2.5 and/or at least about 1:3 and/or at least about 1:4 and/or at least about 1:5 and/or at least about 1:7 and/or at least about 1:10.

In one example, the solid additives, for example wood pulp fibers, may be selected from the group consisting of softwood kraft pulp fibers, hardwood pulp fibers, and mixtures thereof. Non-limiting examples of hardwood pulp fibers include fibers derived from a fiber source selected from the group consisting of: Acacia, Eucalyptus, Maple, Oak, Aspen, Birch, Cottonwood, Alder, Ash, Cherry, Elm, Hickory, Poplar, Gum, Walnut, Locust, Sycamore, Beech, Catalpa, Sassafras, Gmelina, Albizia, Anthocephalus, and Magnolia. Non-limiting examples of softwood pulp fibers include fibers derived from a fiber source selected from the group consisting of: Pine, Spruce, Fir, Tamarack, Hemlock, Cypress, and Cedar. In one example, the hardwood pulp fibers comprise tropical hardwood pulp fibers. Non-limiting examples of suitable tropical hardwood pulp fibers include Eucalyptus pulp fibers, Acacia pulp fibers, and mixtures thereof.

In one example, the hardwood pulp fibers exhibit a Kajaani fiber cell wall thickness of less than 5.98 μm and/or less than 5.96 μm and/or less than 5.94 μm. In another example, the hardwood pulp fibers exhibit a Kajaani fiber width of less than 14.15 μm and/or less than 14.10 μm and/or less than 14.05 μm and/or less than 14.00 μm and/or less than 13.95 μm and/or less than 13.90 μm. In another example, the hardwood pulp fibers exhibit a Kajaani millions of fibers/gram of greater than 24 millions of fibers/gram and/or greater than 20.5 millions of fibers/gram and/or greater than 21 millions of fibers/gram and/or greater than 21.5 millions of fibers/gram and/or greater than 22 millions of fibers/gram and/or greater than 22.5 millions of fibers/gram and/or greater than 23 millions of fibers/gram and/or greater than 23.5 millions of fibers/gram and/or greater than 24 millions of fibers/gram and/or greater than 24.5 millions of fibers/gram and/or greater than 25 millions of fibers/gram. In still another example, the hardwood pulp fibers exhibit a Kajaani fiber cell wall thickness of less than 6.15 μm and/or less than 6.10 μm and/or less than 6.05 μm and/or less than 6.00 μm and/or less than 5.98 μm and/or less than 5.96 μm and/or less than 5.94 μm. In even still another example, the hardwood pulp fibers exhibit a ratio of Kajaani fiber length (μm) to Kajaani fiber width (μm) of less than 45 and/or less than 43 and/or less than 41. In still yet another example, the hardwood pulp fibers exhibit a ratio of Kajaani fiber coarseness of less than 0.074 mg/m and/or less than 0.0735 mg/m In one example, the wood pulp fibers comprise softwood pulp fibers derived from the kraft process and originating from southern climates, such as Southern Softwood Kraft (SSK) pulp fibers. In another example, the wood pulp fibers comprise softwood pulp fibers derived from the kraft process and originating from northern climates, such as Northern Softwood Kraft (NSK) pulp fibers.

The wood pulp fibers present in the fibrous structure may be present at a weight ratio of softwood pulp fibers to hardwood pulp fibers of from 100:0 and/or from 90:10 and/or from 86:14 and/or from 80:20 and/or from 75:25 and/or from 70:30 and/or from 60:40 and/or about 50:50 and/or to 0:100 and/or to 10:90 and/or to 14:86 and/or to 20:80 and/or to 25:75 and/or to 30:70 and/or to 40:60. In one example, the weight ratio of softwood pulp fibers to hardwood pulp fibers is from 86:14 to 70:30.

In one example, the fibrous structures of the present invention comprise one or more trichomes. Non-limiting examples of suitable sources for obtaining trichomes, especially trichome fibers, are plants in the Labiatae (Lamiaceae) family commonly referred to as the mint family. Examples of suitable species in the Labiatae family include *Stachys byzantina*, also known as *Stachys lanata* commonly referred to as lamb's ear, woolly betony, or woundwort. The term *Stachys byzantina* as used herein also includes cultivars *Stachys byzantina* 'Primrose Heron', *Stachys byzantina* 'Helene von Stein' (sometimes referred to as *Stachys byzantina* 'Big Ears'), *Stachys byzantina* 'Cotton Boll', *Stachys byzantina* 'Variegated' (sometimes referred to as *Stachys byzantina* 'Striped Phantom'), and *Stachys byzantina* 'Silver Carpet'.

In one example, the fibrous structures of the present invention exhibit a pore volume distribution such that greater than 8% and/or at least 10% and/or at least 14% and/or at least 18% and/or at least 20% and/or at least 22% and/or at least 25% and/or at least 29% and/or at least 34% and/or at least 40% and/or at least 50% of the total pore volume present in the fibrous structures exists in pores of radii of from 2.5 μm to 50 μm as measured by the Pore Volume Distribution Test Method described herein.

In another example, the fibrous structures of the present invention exhibit a sled surface drying time of less than 50 seconds and/or less than 45 seconds and/or less than 40 seconds and/or less than 35 seconds and/or 30 seconds and/or 25 seconds and/or 20 seconds as measured by the Sled Surface Drying Test Method described herein.

In yet another example, the fibrous structures of the present invention exhibit a pore volume distribution such that at least 2% and/or at least 9% and/or at least 10% and/or at least 12% and/or at least 17% and/or at least 18% and/or at least 28% and/or at least 32% and/or at least 43% of the total pore volume present in the fibrous structure exists in pores of radii of from 91 μm to 140 μm as measured by the Pore Volume Distribution Test Method described herein.

In one example, the fibrous structure of the present invention exhibits at least a bi-modal pore volume distribution (i.e., the pore volume distribution exhibits at least two modes). A fibrous structure according to the present invention exhibiting a bi-modal pore volume distribution provides beneficial absorbent capacity and absorbent rate as a result of the larger radii pores and beneficial surface drying as a result of the smaller radii pores.

In still another example, the fibrous structures of the present invention exhibit a VFS of greater than 5 g/g and/or greater than 6 g/g and/or greater than 8 g/g and/or greater than 10 g/g and/or greater than 11 g/g as measured by the VFS Test Method described herein.

In still another example, the fibrous structures of the present invention exhibit a HFS of greater than 5 g/g and/or greater than 6 g/g and/or greater than 8 g/g and/or greater than 10 g/g and/or greater than 11 g/g as measured by the HFS Test Method described herein.

In one example, the fibrous structure of the present invention, alone or as a ply of fibrous structure in a multi-ply fibrous structure, comprises at least one surface (interior or exterior surface in the case of a ply within a multi-ply fibrous structure) that consists of a layer of filaments.

In still another example, the fibrous structure of the present invention, alone or as a ply of fibrous structure in a multi-ply fibrous structure, comprises a scrim material.

In another example, the fibrous structure of the present invention, alone or as a ply of fibrous structure in a multi-ply fibrous structure, comprises a creped fibrous structure. The creped fibrous structure may comprise a fabric creped fibrous structure, a belt creped fibrous structure, and/or a cylinder creped, such as a cylindrical dryer creped fibrous structure. In one example, the fibrous structure may comprise undulations and/or a surface comprising undulations.

In yet another example, the fibrous structure of the present invention, alone or as a ply of fibrous structure in a multi-ply fibrous structure, comprises an uncreped fibrous structure.

In still another example, the fibrous structure of the present invention, alone or as a ply of fibrous structure in a multi-ply fibrous structure, comprises a foreshortened fibrous structure.

Figure 2:
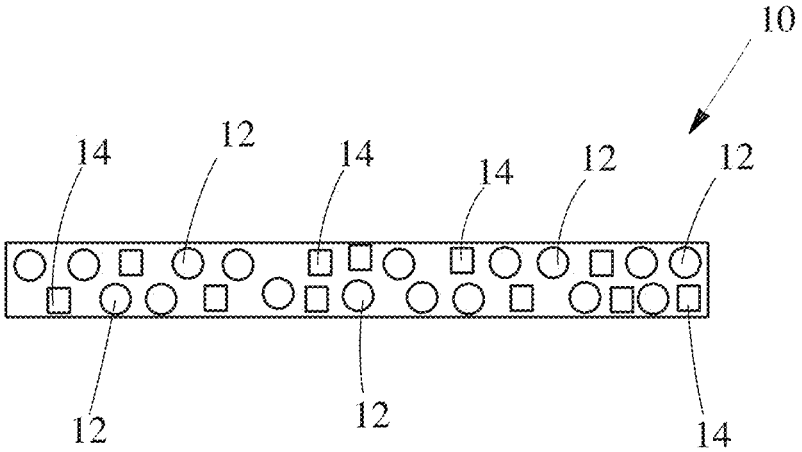
FIG. 2 is a schematic, cross-sectional representation of FIG. 1 taken along line 2-2.

FIGS. 1 and 2 show schematic representations of an example of a fibrous structure in accordance with the present invention. As shown in FIGS. 1 and 2, the fibrous structure 10 may be a co-formed fibrous structure. The fibrous structure 10, as shown in FIGS. 1 and 2, comprises a plurality of filaments 12, such as polypropylene filaments, and a plurality of solid additives, such as wood pulp fibers 14. The filaments 12 may be randomly arranged as a result of the process by which they are spun and/or formed into the fibrous structure 10. The wood pulp fibers 14 may be randomly dispersed throughout the fibrous structure 10 in the x-y plane. The wood pulp fibers 14 may be non-randomly dispersed throughout the fibrous structure in the z-direction. In one example (not shown), the wood pulp fibers 14 are present at a higher concentration on one or more of the exterior, x-y plane surfaces than within the fibrous structure along the z-direction.

Figure 3:
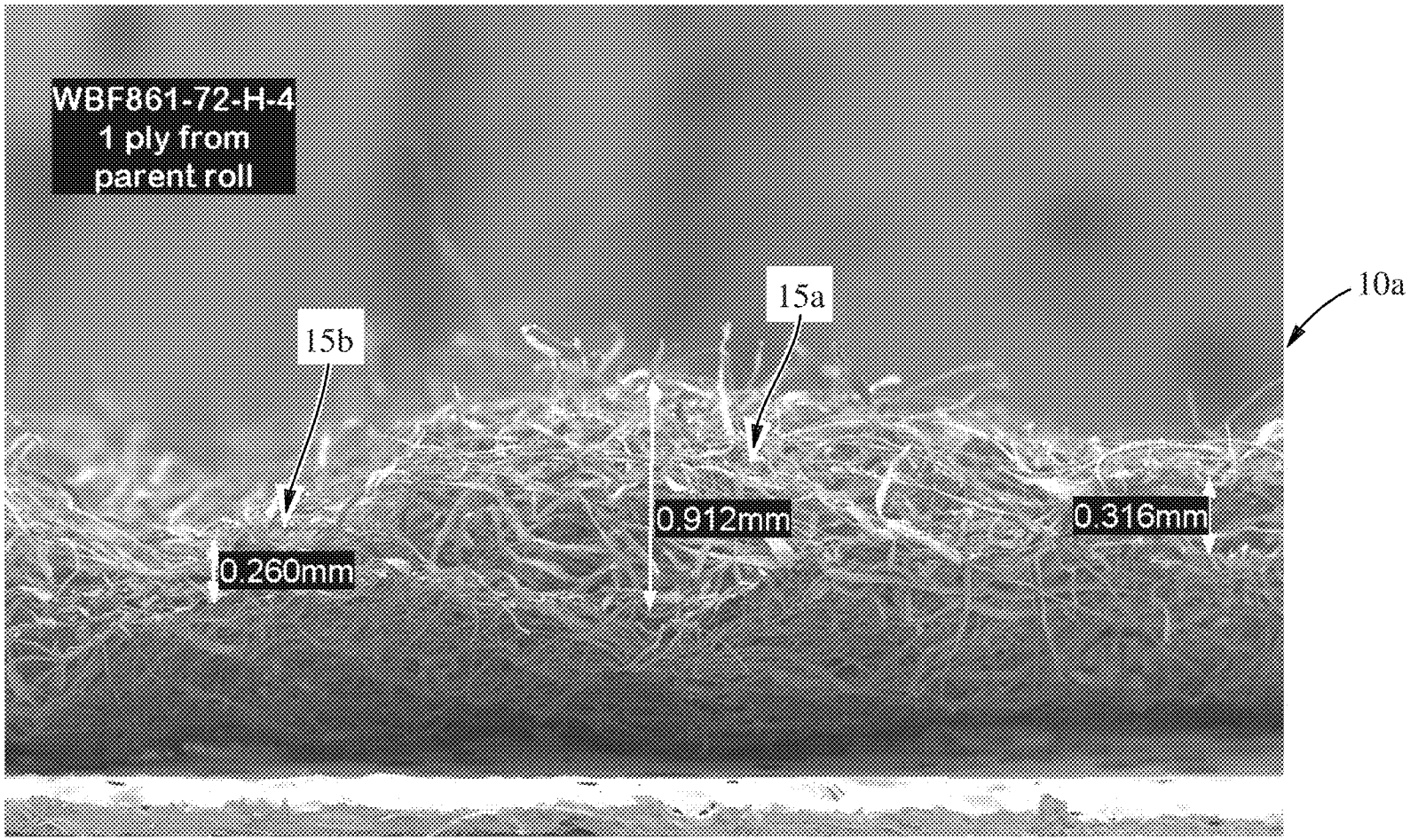
FIG. 3 is a scanning electromicrophotograph (SEM) of a cross-section of another example of fibrous structure according to the present invention.

FIG. 3 shows a cross-sectional, SEM microphotograph of another example of a fibrous structure 10*a* in accordance with the present invention comprising a non-random, repeating pattern of microregions 15*a* and 15*b*. The microregion 15*a* (typically referred to as a "pillow") exhibits a different value of a common intensive property than microregion 15*b* (typically referred to as a "knuckle"). In one example, the microregion 15*b* is a continuous or semi-continuous network and the microregion 15*a* are discrete regions within the continuous or semi-continuous network. The common intensive property may be caliper. In another example, the common intensive property may be density.

Figure 4:
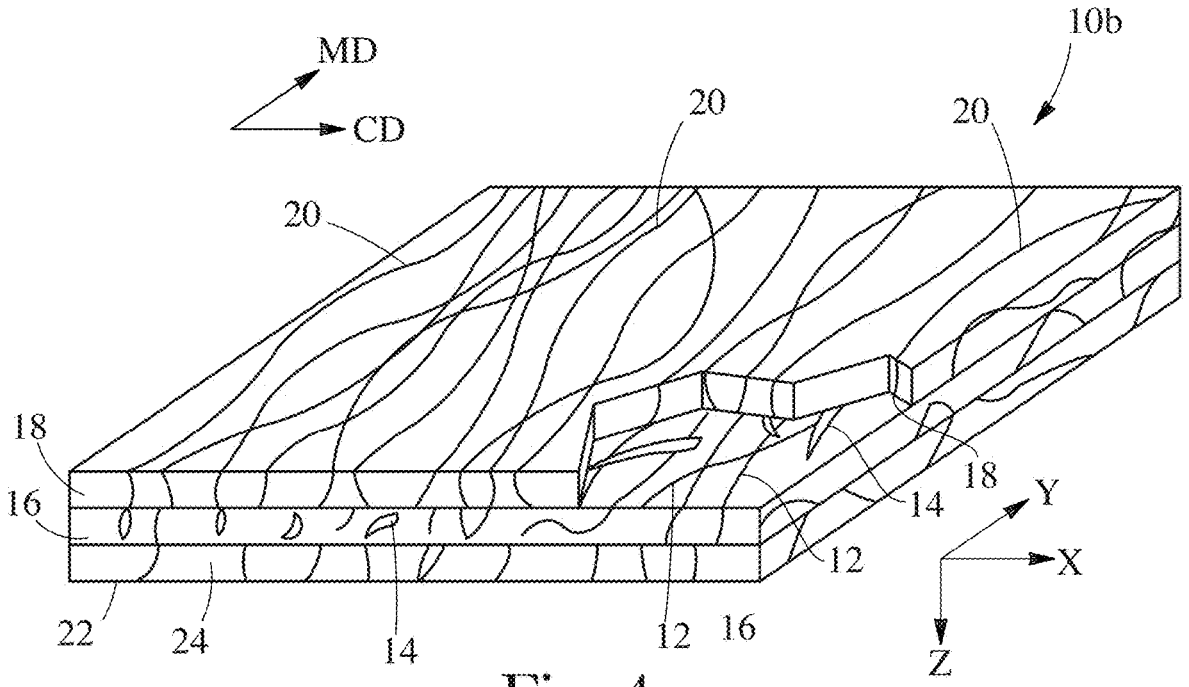
FIG. 4 is a schematic representation of another example of a fibrous structure according to the present invention.

As shown in FIG. 4, another example of a fibrous structure in accordance with the present invention is a layered fibrous structure 10*b*. The layered fibrous structure 10*b* comprises a first layer 16 comprising a plurality of filaments 12, such as polypropylene filaments, and a plurality of solid additives, in this example, wood pulp fibers 14. The layered fibrous structure 10*b* further comprises a second layer 18 comprising a plurality of filaments 20, such as polypropylene filaments. In one example, the first and second layers 16, 18, respectively, are sharply defined zones of concentration of the filaments and/or solid additives. The plurality of filaments 20 may be deposited directly onto a surface of the first layer 16 to form a layered fibrous structure that comprises the first and second layers 16, 18, respectively.

Further, the layered fibrous structure 10*b* may comprise a third layer 22, as shown in FIG. 4. The third layer 22 may comprise a plurality of filaments 24, which may be the same or different from the filaments 20 and/or 16 in the second 18 and/or first 16 layers. As a result of the addition of the third layer 22, the first layer 16 is positioned, for example sandwiched, between the second layer 18 and the third layer 22. The plurality of filaments 24 may be deposited directly onto a surface of the first layer 16, opposite from the second layer, to form the layered fibrous structure 10*b* that comprises the first, second and third layers 16, 18, 22, respectively.

Figure 5:
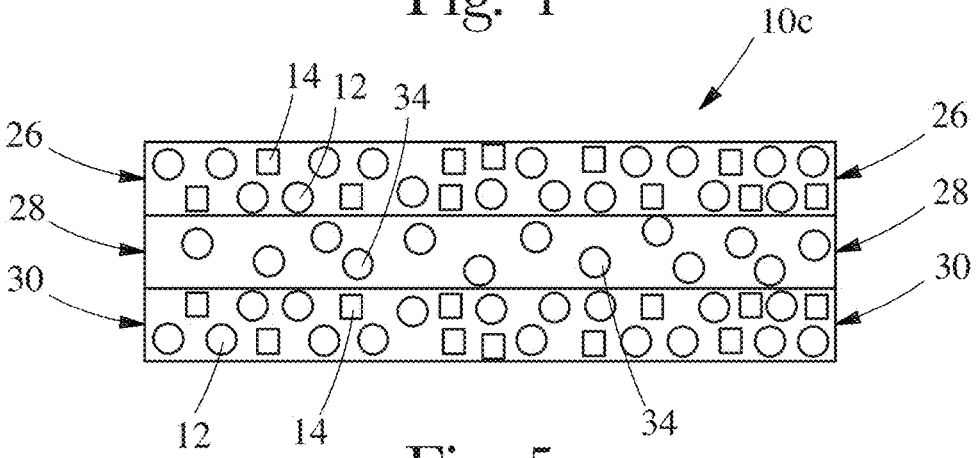
FIG. 5 is a schematic, cross-sectional representation of another example of a fibrous structure according to the present invention.

As shown in FIG. 5, a cross-sectional schematic representation of another example of a fibrous structure in accordance with the present invention comprising a layered fibrous structure 10*c* is provided. The layered fibrous structure 10*c* comprises a first layer 26, a second layer 28 and optionally a third layer 30. The first layer 26 comprises a plurality of filaments 12, such as polypropylene filaments, and a plurality of solid additives, such as wood pulp fibers 14. The second layer 28 may comprise any suitable filaments, solid additives and/or polymeric films. In one example, the second layer 28 comprises a plurality of filaments 34. In one example, the filaments 34 comprise a polymer selected from the group consisting of: polysaccharides, polysaccharide derivatives, polyvinylalcohol, polyvinylalcohol derivatives and mixtures thereof.

In another example of a fibrous structure in accordance with the present invention, instead of being layers of fibrous structure 10*c*, the material forming layers 26, 28 and 30, may be in the form of plies wherein two or more of the plies may be combined to form a multi-ply fibrous structure. The plies may be bonded together, such as by thermal bonding and/or adhesive bonding, to form the multi-ply fibrous structure.

Figure 6A:
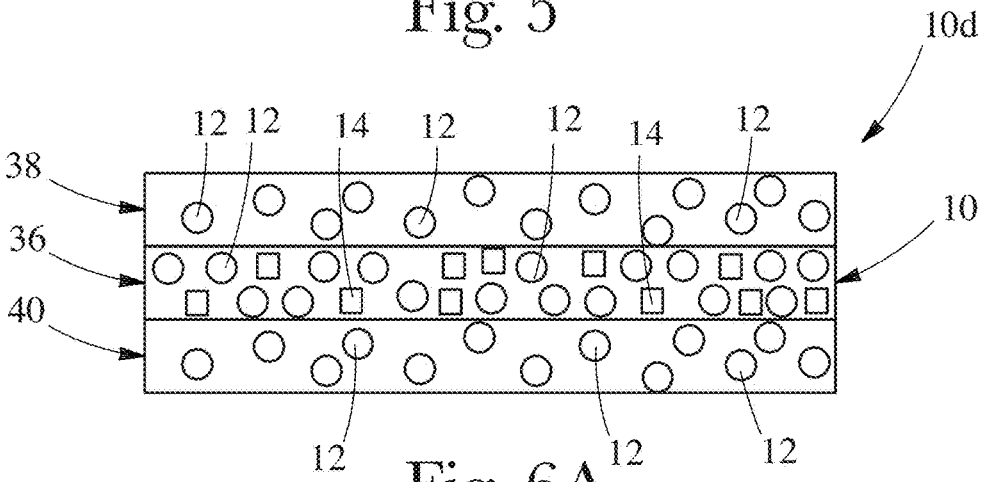
FIG. 6A is a schematic, cross-sectional representation of another example of a fibrous structure according to the present invention.

Another example of a fibrous structure of the present invention in accordance with the present invention is shown in FIG. 6A. The fibrous structure 10*d* may comprise two or more plies, wherein one ply 36 comprises any suitable fibrous structure in accordance with the present invention, for example fibrous structure 10 as shown and described in FIGS. 1 and 2 and another ply 38 comprising any suitable fibrous structure, for example a fibrous structure comprising filaments 12, such as polypropylene filaments. The fibrous structure of ply 38 may be in the form of a scrim material, such as a net and/or mesh and/or other structure that comprises pores that expose one or more portions of the fibrous structure 10*d* to an external environment and/or at least to liquids that may come into contact, at least initially, with the fibrous structure of ply 38. In addition to ply 38, the fibrous structure 10*d* may further comprise ply 40. Ply 40 may comprise a fibrous structure comprising filaments 12, such as polypropylene filaments, and may be the same or different from the fibrous structure of ply 38.

Two or more of the plies 36, 38 and 40 may be bonded together, such as by thermal bonding and/or adhesive bonding, to form a multi-ply fibrous structure. After a bonding operation, especially a thermal bonding operation, it may be difficult to distinguish the plies of the fibrous structure 10*d* and the fibrous structure 10*d* may visually and/or physically be a similar to a layered fibrous structure in that one would have difficulty separating the once individual plies from each other.

Figure 6B:
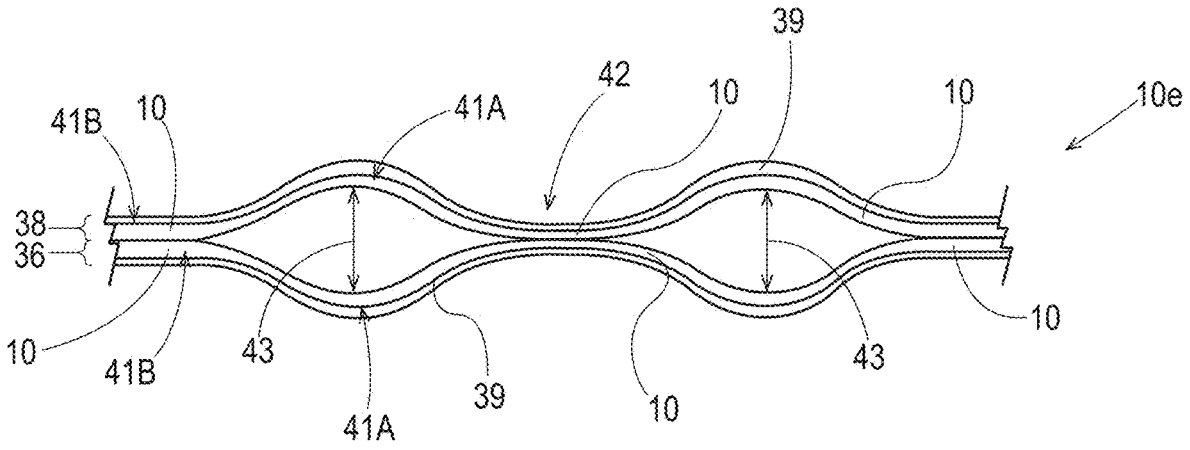
FIG. 6B is a schematic, cross-sectional representation of another example of a fibrous structure according to the present invention.

As shown in FIG. 6B another example of a fibrous structure of the present invention comprises two or more plies, 36 and 38. At least one of the plies 36 and 38 comprises a fibrous structure 20 comprising a plurality of filaments (not shown), such as polypropylene filaments, and a plurality of solid additive (not shown). In one example, the at least one of the plies 36 and 38 comprises a co-formed fibrous structure. In addition, at least one of the plies 36 and 38, comprises a scrim material 39. The scrim material 39 may comprise a plurality of filaments (not shown), such as polypropylene filaments. In one example, the scrim material 39 consists of a plurality of filaments.

Figure 7A:
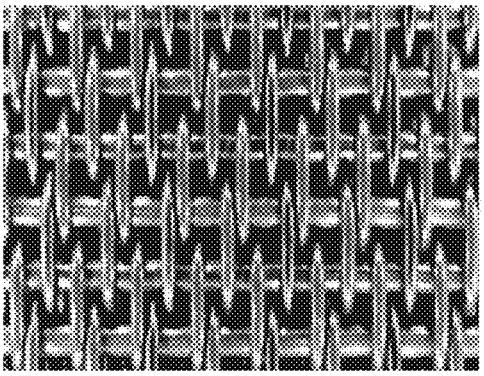
FIG. 7A is photograph of an example of a fabric used in accordance with the present invention.
Figure 7B:
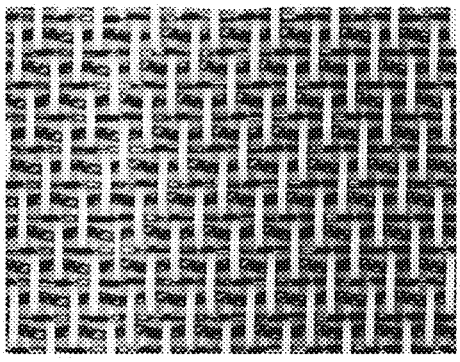
FIG. 7B is photograph of another example of a fabric used in accordance with the present invention.

At least one or more of the fibrous structure plies 36 and 38 comprise two or more regions that exhibit different values of a common intensive property, for example different densities. Such regions may be imparted to the fibrous structure plies 36 and 38 by passing the fibrous structure 10 being carried on a porous belt or fabric, such as a forming fabric through a nip formed by two rollers, such as a heated steel roll and a rubber roll, that causes portions of the fibrous structure 10 to be deflected into one or more pores of the porous belt or fabric. This deflection results in the fibrous structure 10 exhibiting two or more regions 41A and 41B of different values of a common intensive property. Non-limiting examples of suitable fabrics for use in this process are commercially available from Albany International under trade names such as VeloStat, for example VeloStat 170PC740 as shown in FIG. 7A, ElectroTech, for example ElectroTech 100S as shown in FIG. 7B, and MicroStat.

As shown in FIG. 6B, the two or more plies 36 and 38 may be associated with one another to form a multi-ply fibrous structure 10*e*. The plies 36 and 38 may comprise thermal bond points 42 and interply void volumes 43. The interply void volumes 43 are substantially free of filaments and/or fibers. In one example, the interply void volume 43 is a visible interply void volume (a z-direction void volume) of at least 20 μm and/or at least 50 μm and/or at least 100 μm and/or at least 150 μm and/or at least 200 μm and/or at least 250 μm and/or at least 300 μm. Such a void volume can be identified and measured by any suitable imaging technology known to those skilled in the art. Non-limiting examples of suitable imaging technologies include microtomes, SEM, and MikroCT.

Figure 8:
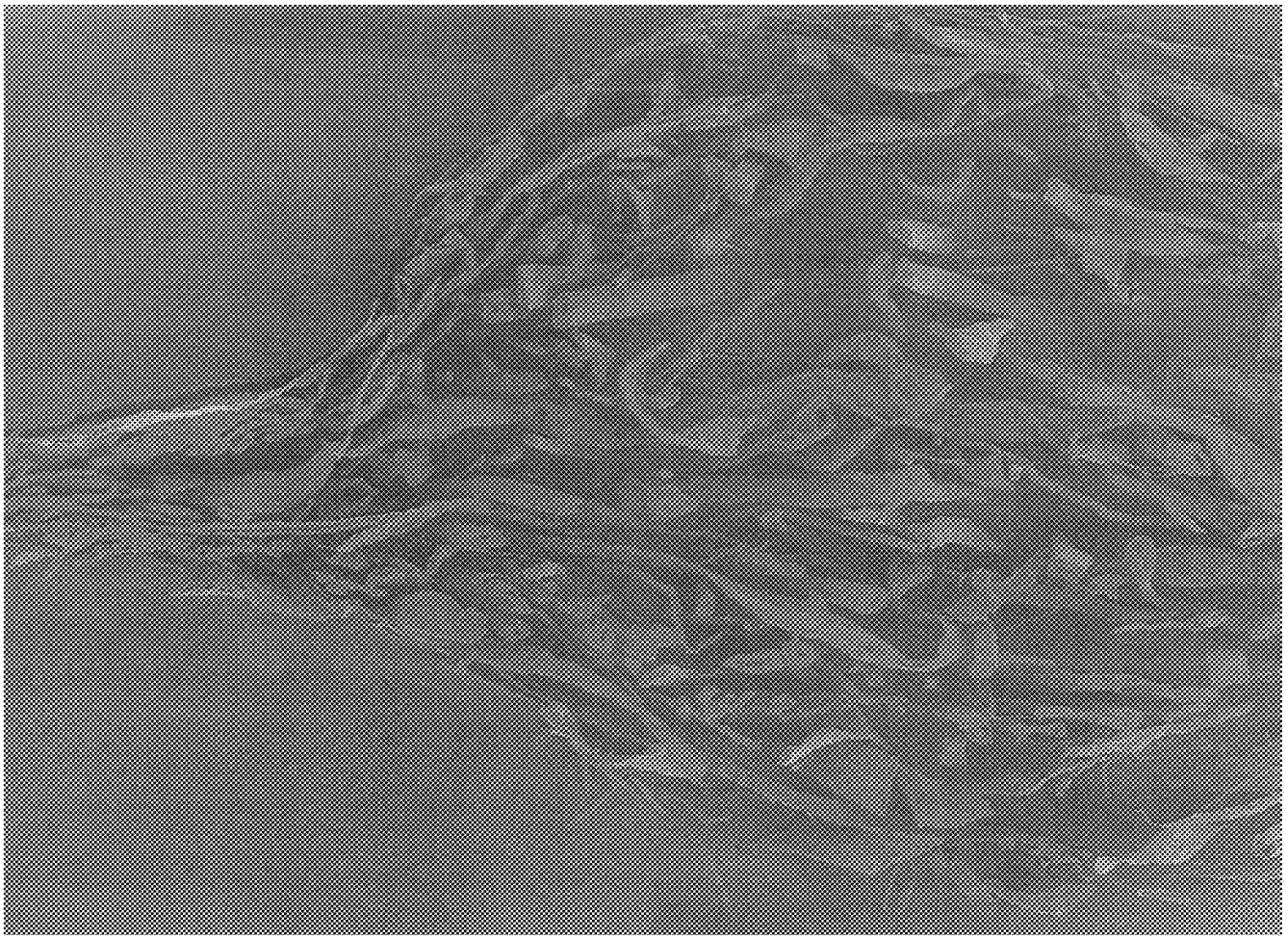
FIG. 8 is a SEM of a cross-section of an example of a known fibrous structure.
Figure 9:
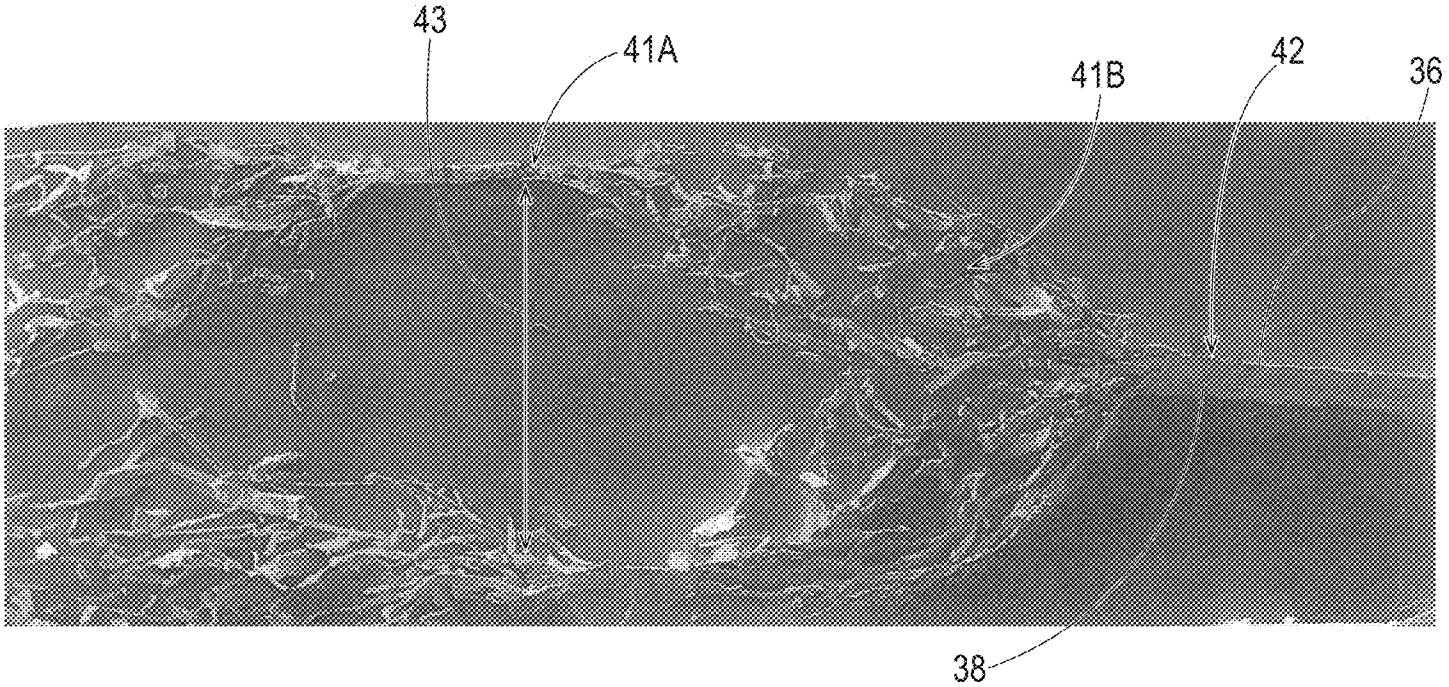
FIG. 9 is a SEM of a cross-section of an example of a fibrous structure according to the present invention.

FIG. 8 is a sectional SEM image of a multi-ply fibrous structure comprising filaments and fibers that is void of a visible interply void volume of the present invention whereas FIG. 9 is a sectional SEM image of a portion of a multi-ply fibrous structure of the present invention comprising filaments and fibers (similar to FIG. 6B), where the multi-ply fibrous structure comprises a visible interply void volume 43 of at least 200 μm comprising two or more regions 41A (higher density) and 41B (lower density) that differ in density values relative to one another present in a non-thermal bond point 42 of the multi-ply fibrous structure.

In one example, one ply of the multi-ply fibrous structures, such as ply 36, may comprise a fibrous structure that exhibits a basis weight of at least about 15 g/m$^2$ and/or at least about 20 g/m$^2$ and/or at least about 25 g/m$^2$ and/or at least about 30 g/m$^2$ up to about 120 g/m$^2$ and/or 100 g/m$^2$ and/or 80 g/m$^2$ and/or 60 g/m$^2$ and the plies 38 and 42, when present, independently and individually, may comprise fibrous structures that exhibit basis weights of less than about 10 g/m$^2$ and/or less than about 7 g/m$^2$ and/or less than about 5 g/m$^2$ and/or less than about 3 g/m$^2$ and/or less than about 2 g/m$^2$ and/or to about 0 g/m$^2$ and/or 0.5 g/m$^2$.

Plies 38 and 40, when present, may help retain the solid additives, in this case the wood pulp fibers 14, on and/or within the fibrous structure of ply 36 thus reducing lint and/or dust (as compared to a single-ply fibrous structure comprising the fibrous structure of ply 36 without the plies 38 and 40) resulting from the wood pulp fibers 14 becoming free from the fibrous structure of ply 36.

The fibrous structures of the present invention and/or any sanitary tissue products comprising such fibrous structures may be subjected to any post-processing operations such as embossing operations, printing operations, tuft-generating operations, thermal bonding operations, ultrasonic bonding operations, perforating operations, surface treatment operations such as application of lotions, silicones and/or other materials and mixtures thereof.

Non-limiting examples of suitable polypropylenes for making the filaments of the present invention are commercially available from Lyondell-Basell and Exxon-Mobil.

Any hydrophobic or non-hydrophilic materials within the fibrous structure, such as polypropylene filaments, may be surface treated and/or melt treated with a hydrophilic modifier. Non-limiting examples of surface treating hydrophilic modifiers include surfactants, such as Triton X-100. Non-limiting examples of melt treating hydrophilic modifiers that are added to the melt, such as the polypropylene melt, prior to spinning filaments, include hydrophilic modifying melt additives such as VW351 and/or S-1416 commercially available from Polyvel, Inc. and Irgasurf commercially available from Ciba. The hydrophilic modifier may be associated with the hydrophobic or non-hydrophilic material at any suitable level known in the art. In one example, the hydrophilic modifier is associated with the hydrophobic or non-hydrophilic material at a level of less than about 20% and/or less than about 15% and/or less than about 10% and/or less than about 5% and/or less than about 3% to about 0% by dry weight of the hydrophobic or non-hydrophilic material.

The fibrous structures of the present invention may include optional additives, each, when present, at individual levels of from about 0% and/or from about 0.01% and/or from about 0.1% and/or from about 1% and/or from about 2% to about 95% and/or to about 80% and/or to about 50% and/or to about 30% and/or to about 20% by dry weight of the fibrous structure. Non-limiting examples of optional additives include permanent wet strength agents, temporary wet strength agents, dry strength agents such as carboxymethylcellulose and/or starch, softening agents, lint reducing agents, opacity increasing agents, wetting agents, odor absorbing agents, perfumes, temperature indicating agents, color agents, dyes, osmotic materials, microbial growth detection agents, antibacterial agents and mixtures thereof.

The fibrous structure of the present invention may itself be a sanitary tissue product. It may be convolutedly wound about a core to form a roll. It may be combined with one or more other fibrous structures as a ply to form a multi-ply sanitary tissue product. In one example, a co-formed fibrous structure of the present invention may be convolutedly wound about a core to form a roll of co-formed sanitary tissue product. The rolls of sanitary tissue products may also be coreless.

Table 1 below set out data for examples of fibrous structures of the present invention and comparative fibrous structures.

TABLE 1

| Fibrous Structure | Filaments | Plies | Total Pore Volume 2.5-50 μm | Total Pore Volume 91-140 μm | Visible Interply Void Volume ≥200 μm | Sled Surface Drying Time (Seconds) |
|---|---|---|---|---|---|---|
| Control | Y | 2 | 1.6% | 63.0% | N | 51.7 |
| Invention A | Y | 2 | 34.8% | 12.3% | Y | 18.6 |
| Invention B | Y | 2 | 14.4% | 18.9% | Y | 27.5 |
| Invention C | Y | 2 | 6.9% | 45.9% | Y | 38.6 |
| Invention D | Y | 2 | 17.4% | 14.4% | Y | 32.9 |
| Prior Art | Y | 1 | 0.6% | 63.8% | N | 53.8 |
| PEGAS 15 gsm NWBS | Y | 1 | 0.2% | 95.3% | N | 232.6 |
| PGI 15 gsm NW SBTS | Y | 1 | 0.1% | 78.3% | N | 317.5 |
| Concert T-Bal Airlaid | N | 1 | 4.3% | 66.6% | N | 49.3 |
| Duramax ® | Y | 1 | 19.8% | 9.5% | N | 18.7 |
| 2011 Marketed Bounty ® | N | 2 | 19.0% | 12.0% | Y | 13.6 |

Method For Making A Fibrous Structure

Figure 10:
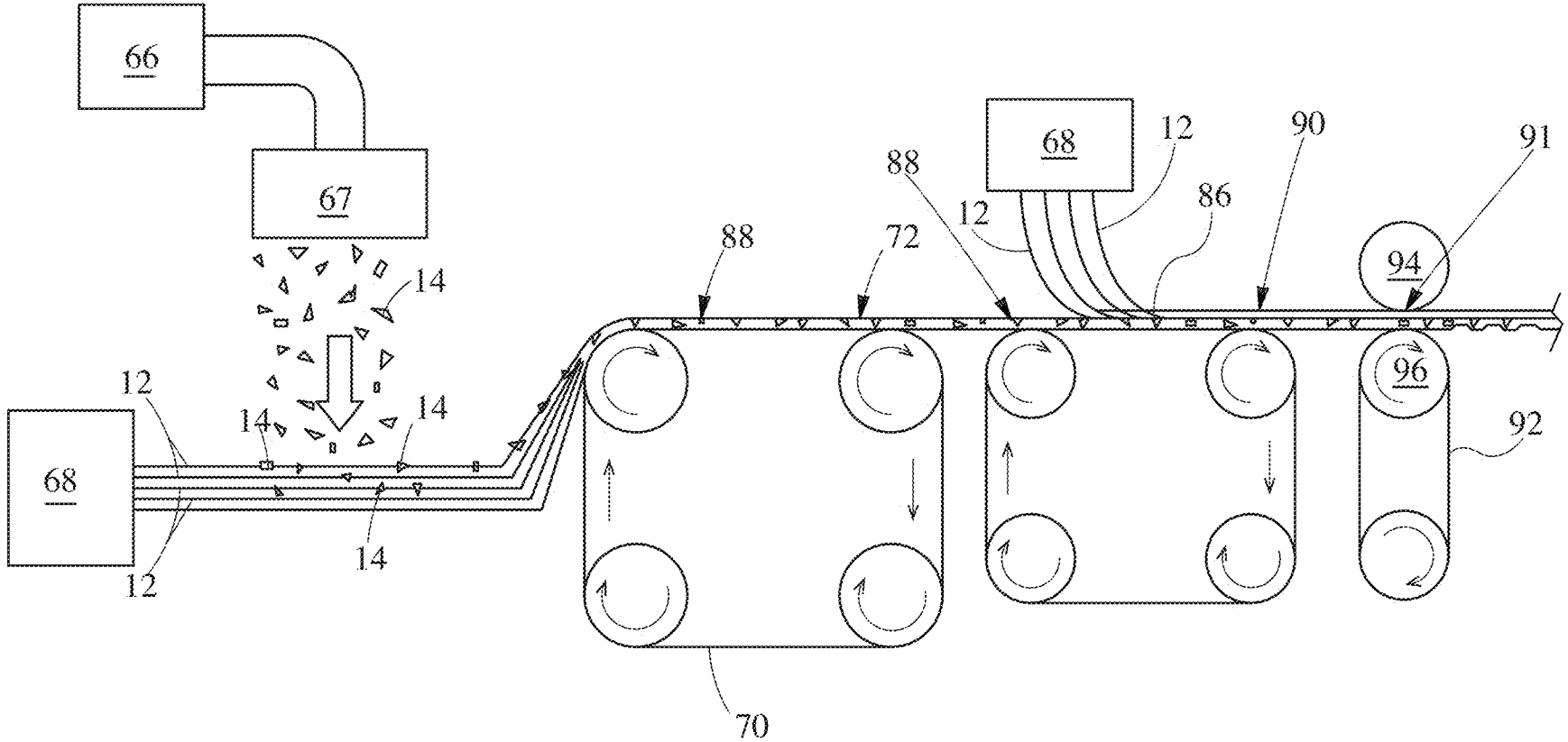
FIG. 10 is a schematic representation of an example of a process for making a fibrous structure according to the present invention.
Figure 11:
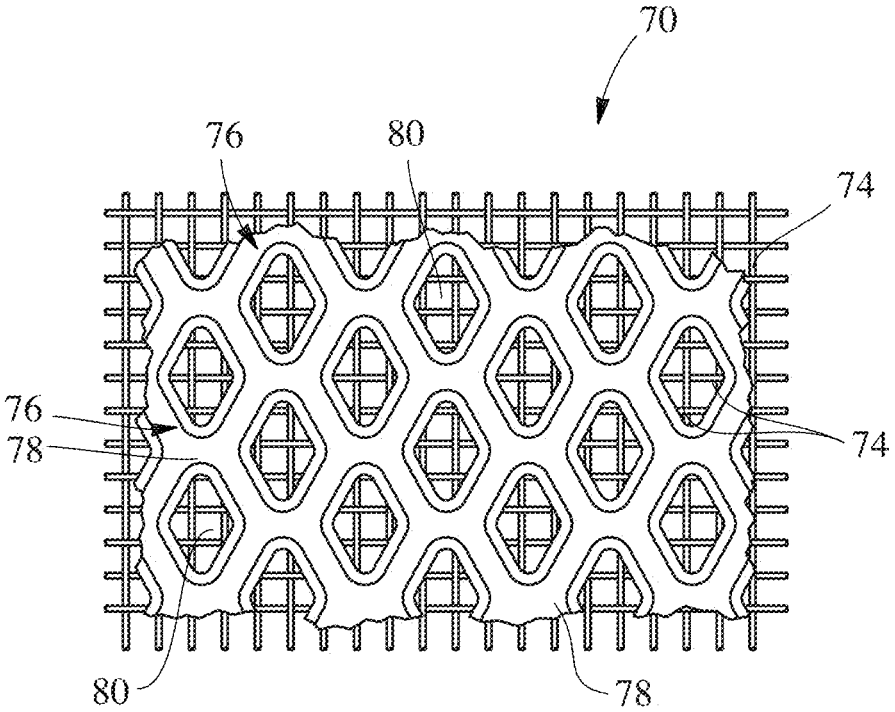
FIG. 11 is a schematic representation of an example of a patterned belt for use in a process according to the present invention.

A non-limiting example of a method for making a fibrous structure according to the present invention is represented in FIG. 10. The method shown in FIG. 10 comprises the step of mixing a plurality of solid additives 14 with a plurality of filaments 12. In one example, the solid additives 14 are wood pulp fibers, such as SSK fibers and/or Eucalyptus fibers, and the filaments 12 are polypropylene filaments. The solid additives 14 may be combined with the filaments 12, such as by being delivered to a stream of filaments 12 from a hammermill 66 via a solid additive spreader 67 to form a mixture of filaments 12 and solid additives 14. In one example, an apparatus for separating the solid additives 14 as described in US Patent Application Publication No. 20110303373 may be used to facilitate delivery of the solid additives 14. In one example, the solid additives 14 may be delivered to the stream of filaments 12 from two or more sides of the stream of filaments 12. The filaments 12 may be created by meltblowing from a meltblow die 68. The mixture of solid additives 14 and filaments 12 are collected on a collection device, such as a belt 70 to form a fibrous structure 72. The collection device may be a patterned and/or molded belt that results in the fibrous structure 72 exhibiting a surface pattern, such as a non-random, repeating pattern of microregions. The molded belt may have a three-dimensional pattern on it that gets imparted to the fibrous structure 72 during the process. For example, the patterned belt 70, as shown in FIG. 11, may comprise a reinforcing structure, such as a fabric 74, upon which a polymer resin 76 is applied in a pattern. The pattern may comprise a continuous or semi-continuous network 78 of the polymer resin 76 within which one or more discrete conduits 80 are arranged.

In one example of the present invention, the fibrous structures are made using a die comprising at least one filament-forming hole, and/or 2 or more and/or 3 or more rows of filament-forming holes from which filaments are spun. At least one row of holes contains 2 or more and/or 3 or more and/or 10 or more filament-forming holes. In addition to the filament-forming holes, the die comprises fluid-releasing holes, such as gas-releasing holes, in one example air-releasing holes, that provide attenuation to the filaments formed from the filament-forming holes. One or more fluid-releasing holes may be associated with a filament-forming hole such that the fluid exiting the fluid-releasing hole is parallel or substantially parallel (rather than angled like a knife-edge die) to an exterior surface of a filament exiting the filament-forming hole. In one example, the fluid exiting the fluid-releasing hole contacts the exterior surface of a filament formed from a filament-forming hole at an angle of less than 30° and/or less than 20° and/or less than 10° and/or less than 5° and/or about 0°. One or more fluid releasing holes may be arranged around a filament-forming hole. In one example, one or more fluid-releasing holes are associated with a single filament-forming hole such that the fluid exiting the one or more fluid releasing holes contacts the exterior surface of a single filament formed from the single filament-forming hole. In one example, the fluid-releasing hole permits a fluid, such as a gas, for example air, to contact the exterior surface of a filament formed from a filament-forming hole rather than contacting an inner surface of a filament, such as what happens when a hollow filament is formed.

Figure 12:
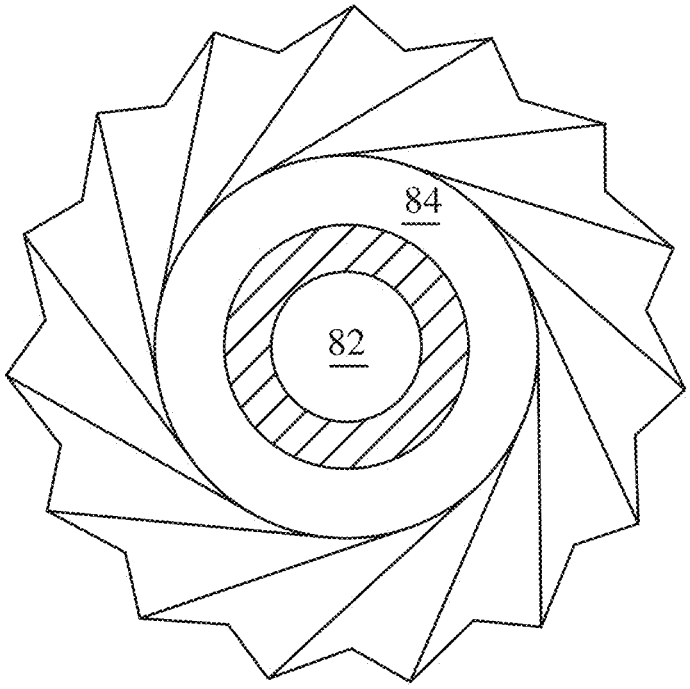
FIG. 12 is a schematic representation of an example of a filament-forming hole and fluid-releasing hole from a suitable die useful in making a fibrous structure according to the present invention.

In one example, the die comprises a filament-forming hole positioned within a fluid-releasing hole. The fluid-releasing hole 82 may be concentrically or substantially concentrically positioned around a filament-forming hole 84 such as is shown in FIG. 12.

After the fibrous structure 72 has been formed on the collection device, such as a patterned belt 70, the fibrous structure 72 may be calendered, for example, while the fibrous structure 72 is still on the collection device. In addition, the fibrous structure 72 may be subjected to post-processing operations such as embossing, thermal bonding, tuft-generating operations, moisture-imparting operations, and surface treating operations to form a finished fibrous structure. One example of a surface treating operation that the fibrous structure may be subjected to is the surface application of an elastomeric binder, such as ethylene vinyl acetate (EVA), latexes, and other elastomeric binders. Such an elastomeric binder may aid in reducing the lint created from the fibrous structure during use by consumers. The elastomeric binder may be applied to one or more surfaces of the fibrous structure in a pattern, especially a non-random, repeating pattern of microregions, or in a manner that covers or substantially covers the entire surface(s) of the fibrous structure.

In one example, the fibrous structure 72 and/or the finished fibrous structure may be combined with one or more other fibrous structures. For example, another fibrous structure, such as a filament-containing fibrous structure 86, such as a polypropylene filament fibrous structure, may be associated with a surface 88 of the fibrous structure 72 and/or the finished fibrous structure. The polypropylene filament fibrous structure may be formed by meltblowing polypropylene filaments 12 (filaments that comprise a second polymer that may be the same or different from the polymer of the filaments 12 in the fibrous structure 72) from a meltblow die 68 onto a surface 88 of the fibrous structure 72 and/or finished fibrous structure to form a scrim material 39 resulting in a formed fibrous structure 90.

In another example, the polypropylene filament fibrous structure may be formed by meltblowing filaments 12 comprising a second polymer that may be the same or different from the polymer of the filaments 12 in the fibrous structure 72 onto a collection device to form the polypropylene filament fibrous structure. The polypropylene filament fibrous structure may then be combined with the fibrous structure 72 or the finished fibrous structure to make a two-ply fibrous structure—three-ply if the fibrous structure 72 or the finished fibrous structure is positioned between two plies of the polypropylene filament fibrous structure like that shown in FIG. 6A for example. The polypropylene filament fibrous structure may be thermally bonded to the fibrous structure 72 or the finished fibrous structure via a thermal bonding operation.

The formed fibrous structure 90 may then be densified, for example with a non-random repeating pattern. In one example, the formed fibrous structure 90 may be carried on a porous belt and/or fabric, for example as shown in FIGS. 7A and 7B, through a nip 91, for example a nip formed by a heated steel roll 94 and a rubber roll 96 such that the formed fibrous structure 90 is deflected into one or more of the pores of the porous belt resulting in localized regions of densification. Non-limiting examples of suitable porous belts and/or fabrics are commercially available from Albany International under the trade names VeloStat, ElectroTech, and MicroStat. In one example, the nip 91 applies a pressure of at least 5 pounds per lineal inch (pli) and/or at least 10 pli and/or at least 20 pli and/or at least 50 pli and/or at least 80 pli.

In yet another example, the fibrous structure 72 and/or finished fibrous structure may be combined with a filament-containing fibrous structure such that the filament-containing fibrous structure, such as a polysaccharide filament fibrous structure, such as a starch filament fibrous structure, is positioned between two fibrous structures 72 or two finished fibrous structures like that shown in FIG. 5 for example.

In still another example, two plies of fibrous structure 72 comprising a non-random, repeating pattern of microregions may be associated with one another such that protruding microregions, such as pillows, face inward into the two-ply fibrous structure formed. Such a multi-ply fibrous structure according to the present invention may exhibit a z-direction void volume (also referred to as a visible interply void volume) of at least 200 μm and/or at least 250 μm and/or at least 300 μm. Such a visible interply void volume can be identified and measured by any suitable imaging technology known to those skilled in the art. Non-limiting examples of suitable imaging technologies include microtomes, SEM, and MikroCT.

The process for making fibrous structures 72 and/or 90 may be close coupled (where the fibrous structure is convolutedly wound into a roll prior to proceeding to a converting operation) or directly coupled (where the fibrous structure is not convolutedly wound into a roll prior to proceeding to a converting operation) with a converting operation to emboss, print, deform, surface treat, or other post-forming operation known to those in the art. For purposes of the present invention, direct coupling means that the fibrous structure 72 and/or 90 can proceed directly into a converting operation rather than, for example, being convolutedly wound into a roll and then unwound to proceed through a converting operation.

The process of the present invention may include preparing individual rolls of fibrous structure and/or sanitary tissue product comprising such fibrous structure(s) that are suitable for consumer use.

Non-Limiting Example of Process for Making a Fibrous Structure of the Present Invention:

A 20%:27.5%47.5%:5% blend of Lyondell-Basell PH835 polypropylene: Lyondell-Basell Metocene MF650W polypropylene: Exxon-Mobil PP3546 polypropylene: Polyvel S-1416 wetting agent is dry blended, to form a melt blend. The melt blend is heated to 400° F. through a melt extruder. A 15.5 inch wide Biax 12 row spinnerette with 192 nozzles per cross-direction inch, commercially available from Biax Fiberfilm Corporation, is utilized. 40 nozzles per cross-direction inch of the 192 nozzles have a 0.018 inch inside diameter while the remaining nozzles are solid, i.e. there is no opening in the nozzle. Approximately 0.19 grams per hole per minute (ghm) of the melt blend is extruded from the open nozzles to form meltblown filaments from the melt blend. Approximately 415 SCFM of compressed air is heated such that the air exhibits a temperature of 395° F. at the spinnerette. Approximately 475 g/minute of a blend of 70% Golden Isle (from Georgia Pacific) 4825 semi-treated SSK pulp and 30% Eucalyptus is defibrillated through a hammermill to form SSK and Euc wood pulp fibers (solid additive). Air at 85-90° F. and 85% relative humidity (RH) is drawn into the hammermill. Approximately 2400 SCFM of air carries the pulp fibers to two solid additive spreaders. The solid additive spreaders turn the pulp fibers and distribute the pulp fibers in the cross-direction such that the pulp fibers are injected into the meltblown filaments in a perpendicular fashion through a 4 inch×15 inch cross-direction (CD) slot. The two solid additive spreaders are on opposite sides of the meltblown filaments facing one another. A forming box surrounds the area where the meltblown filaments and pulp fibers are commingled. This forming box is designed to reduce the amount of air allowed to enter or escape from this commingling area. A forming vacuum pulls air through a collection device, such as a patterned belt, thus collecting the commingled meltblown filaments and pulp fibers to form a fibrous structure. The fibrous structure formed by this process comprises about 75% by dry fibrous structure weight of pulp and about 25% by dry fibrous structure weight of meltblown filaments.

Optionally, a meltblown layer of the meltblown filaments can be added to one or both sides of the above formed fibrous structure. This addition of the meltblown layer can help reduce the lint created from the fibrous structure during use by consumers and is preferably performed prior to any thermal bonding operation of the fibrous structure. The meltblown filaments for the exterior layers can be the same or different than the meltblown filaments used on the opposite layer or in the center layer(s).

The fibrous structure, while on a patterned belt (e.g. Velostat 170PC 740 by Albany International), is calendered at about 40 PLI (Pounds per Linear CD inch) with a metal roll facing the fibrous structure and a rubber coated roll facing the patterned belt. The steel roll having an internal temperature of 300° F. as supplied by an oil heater.

Optionally, the fibrous structure can be adhered to a metal roll, or creping drum, using sprayed, printed, slot extruded (or other known methodology) creping adhesive solution. The fibrous structure is then creped from the creping drum and foreshortened. Alternatively or in addition to creping, the fibrous structure may be subjected to mechanical treatments such as ring rolling, gear rolling, embossing, rush transfer, tuft-generating operations, and other similar fibrous structure deformation operations.

Optionally, two or more plies of the fibrous structure can be embossed and/or laminated and/or thermally bonded together to form a multi-ply fibrous structure.

The fibrous structure may be convolutedly wound to form a roll of fibrous structure. The end edges of the roll of fibrous structure may be contacted with a material to create bond regions.

Test Methods

Unless otherwise specified, all tests described herein including those described under the Definitions section and the following test methods are conducted on samples that have been conditioned in a conditioned room at a temperature of 23° C.±1.0° C. and a relative humidity of 50%±2% for a minimum of 12 hours prior to the test. All plastic and paper board packaging articles of manufacture, if any, must be carefully removed from the samples prior to testing. The samples tested are "usable units." "Usable units" as used herein means sheets, flats from roll stock, pre-converted flats, and/or single or multi-ply products. Except where noted all tests are conducted in such conditioned room, all tests are conducted under the same environmental conditions and in such conditioned room. Discard any damaged product. Do not test samples that have defects such as wrinkles, tears, holes, and like. All instruments are calibrated according to manufacturer's specifications. Samples conditioned as described herein are considered dry samples (such as "dry fibrous structures") for purposes of this invention.

Pore Volume Distribution Test Method

Pore Volume Distribution measurements are made on a TRI/Autoporosimeter (TRI/Princeton Inc. of Princeton, N.J.). The TRI/Autoporosimeter is an automated computer-controlled instrument for measuring pore volume distributions in porous materials (e.g., the volumes of different size pores within the range from 1 to 1000 μm effective pore radii). Complimentary Automated Instrument Software, Release 2000.1, and Data Treatment Software, Release 2000.1 is used to capture, analyze and output the data. More information on the TRI/Autoporosimeter, its operation and data treatments can be found in The Journal of Colloid and Interface Science 162 (1994), pgs 163-170, incorporated here by reference.

As used in this application, determining Pore Volume Distribution involves recording the increment of liquid that enters a porous material as the surrounding air pressure changes. A sample in the test chamber is exposed to precisely controlled changes in air pressure. The size (radius) of the largest pore able to hold liquid is a function of the air pressure. As the air pressure increases (decreases), different size pore groups drain (absorb) liquid. The pore volume of each group is equal to this amount of liquid, as measured by the instrument at the corresponding pressure. The effective radius of a pore is related to the pressure differential by the following relationship.

$$\text{Pressure differential}=[(2)\gamma \cos \Theta]/\text{effective radius}$$

where $\gamma$=liquid surface tension, and $\Theta$=contact angle.

Typically pores are thought of in terms such as voids, holes or conduits in a porous material. It is important to note that this method uses the above equation to calculate effective pore radii based on the constants and equipment controlled pressures. The above equation assumes uniform cylindrical pores. Usually, the pores in natural and manufactured porous materials are not perfectly cylindrical, nor all uniform. Therefore, the effective radii reported here may not equate exactly to measurements of void dimensions obtained by other methods such as microscopy. However, these measurements do provide an accepted means to characterize relative differences in void structure between materials.

The equipment operates by changing the test chamber air pressure in user-specified increments, either by decreasing pressure (increasing pore size) to absorb liquid, or increasing pressure (decreasing pore size) to drain liquid. The liquid volume absorbed at each pressure increment is the cumulative volume for the group of all pores between the preceding pressure setting and the current setting.

In this application of the TRI/Autoporosimeter, the liquid is a 0.2 weight % solution of octylphenoxy polyethoxy ethanol (Triton X-100 from Union Carbide Chemical and Plastics Co. of Danbury, Conn.) in distilled water. The instrument calculation constants are as follows: $\rho$ (density)= 1 g/cm$^3$; $\gamma$ (surface tension)=31 dynes/cm; cos $\Theta$=1. A 1.2 μm Millipore Glass Filter (Millipore Corporation of Bedford, Mass.; Catalog #GSWP09025) is employed on the test chamber's porous plate. A plexiglass plate weighing about 24 g (supplied with the instrument) is placed on the sample to ensure the sample rests flat on the Millipore Filter. No additional weight is placed on the sample.

The remaining user specified inputs are described below. The sequence of pore sizes (pressures) for this application is as follows (effective pore radius in μm): 1, 2.5, 5, 10, 15, 20, 30, 40, 50, 60, 70, 80, 90, 100, 120, 140, 160, 180, 200, 225, 250, 275, 300, 350, 400, 500, 600, 800, 1000. This sequence starts with the sample dry, saturates it as the pore settings increase (typically referred to with respect to the procedure and instrument as the 1$^{st}$ absorption).

In addition to the test materials, a blank condition (no sample between plexiglass plate and Millipore Filter) is run to account for any surface and/or edge effects within the chamber. Any pore volume measured for this blank run is subtracted from the applicable pore grouping of the test sample. This data treatment can be accomplished manually or with the available TRI/Autoporosimeter Data Treatment Software, Release 2000.1.

Percent (%) Total Pore Volume is a percentage calculated by taking the volume of fluid in the specific pore radii range divided by the Total Pore Volume. The TRI/Autoporosimeter outputs the volume of fluid within a range of pore radii. The first data obtained is for the "2.5 micron" pore radii which includes fluid absorbed between the pore sizes of 1 to 2.5 micron radius. The next data obtained is for "5 micron" pore radii, which includes fluid absorbed between the 2.5 micron and 5 micron radii, and so on. Following this logic, to obtain the volume held within the range of 91-140 micron radii, one would sum the volumes obtained in the range titled "100 micron", "110 micron", "120 micron", "130 micron", and finally the "140 micron" pore radii ranges. For example, % Total Pore Volume 91-140 micron pore radii=(volume of fluid between 91-140 micron pore radii)/Total Pore Volume.

Vertical Full Sheet (VFS) Test Method

The Vertical Full Sheet (VFS) test method determines the amount of distilled water absorbed and retained by a fibrous structure of the present invention. This method is performed by first weighing a sample of the fibrous structure to be tested (referred to herein as the "dry weight of the sample"), then thoroughly wetting the sample, draining the wetted sample in a vertical position and then reweighing (referred to herein as "wet weight of the sample"). The absorptive capacity of the sample is then computed as the amount of water retained in units of grams of water absorbed by the sample. When evaluating different fibrous structure samples, the same size of fibrous structure is used for all samples tested.

The apparatus for determining the VFS capacity of fibrous structures comprises the following:

1) An electronic balance with a sensitivity of at least ±0.01 grams and a minimum capacity of 1200 grams. The balance should be positioned on a balance table and slab to minimize the vibration effects of floor/benchtop weighing. The balance should also have a special balance pan to be able to handle the size of the sample tested (i.e.; a fibrous structure sample of about 11 in. by 11 in.). The balance pan can be made out of a variety of materials. Plexiglass is a common material used.

Figure 13A:
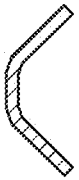
FIGS. 13 and 13A are a diagram of a support rack utilized in the VFS Test Method described herein.
Figure 13:
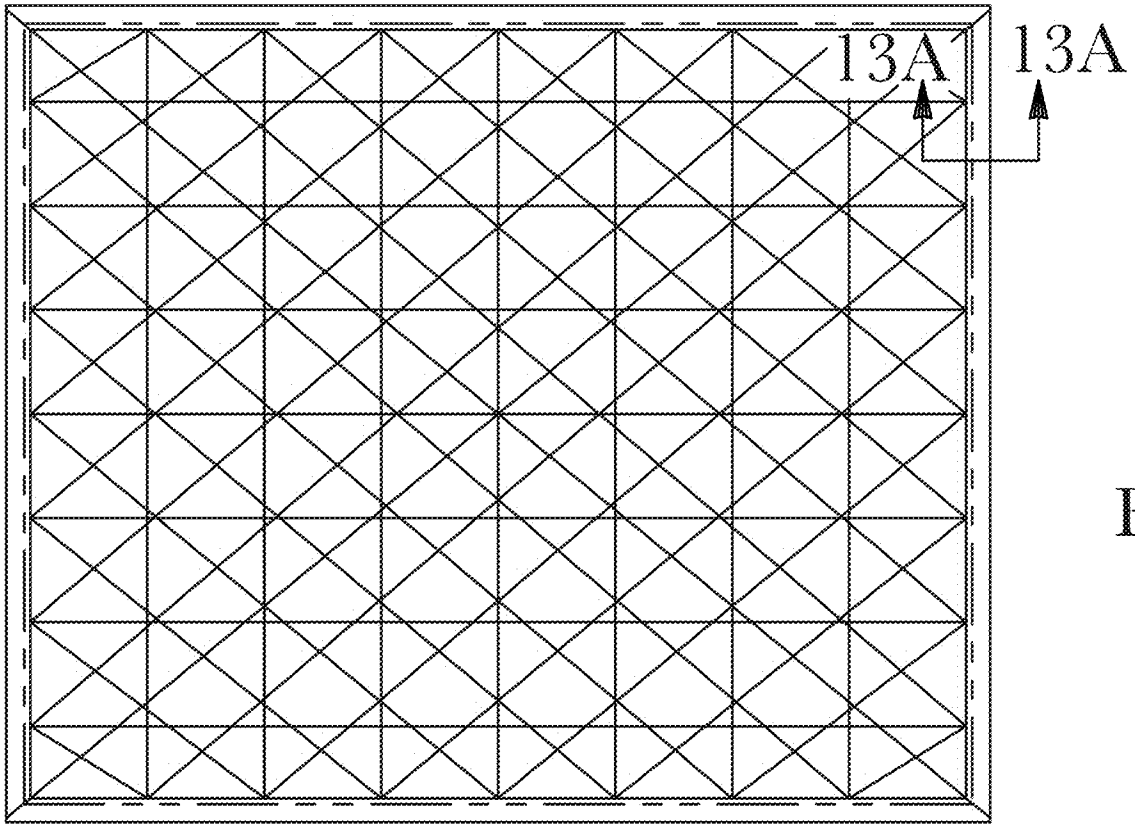
Figure 14A:
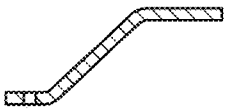
FIGS. 14 and 14A are a diagram of a support rack cover utilized in the VFS Test Method described herein.
Figure 14:
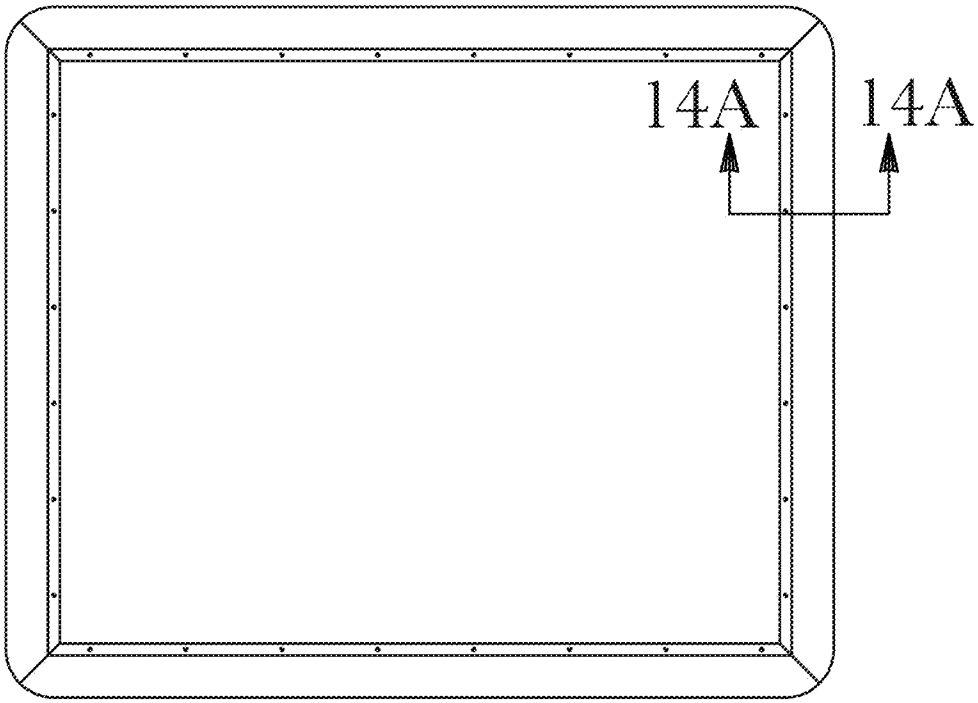

2) A sample support rack (FIGS. 13 and 13A) and sample support rack cover (FIGS. 14 and 14A) is also required. Both the rack and cover are comprised of a lightweight metal frame, strung with 0.012 in. diameter monofilament so as to form a grid as shown in FIG. 13. The size of the support rack and cover is such that the sample size can be conveniently placed between the two.

The VFS test is performed in an environment maintained at 23±1° C. and 50±2% relative humidity. A water reservoir or tub is filled with distilled water at 23±1° C. to a depth of 3 inches.

Eight 7.5 inch×7.5 inch to 11 inch×11 inch samples of a fibrous structure to be tested are carefully weighed on the balance to the nearest 0.01 grams. The dry weight of each sample is reported to the nearest 0.01 grams. The empty sample support rack is placed on the balance with the special balance pan described above. The balance is then zeroed (tared). One sample is carefully placed on the sample support rack. The support rack cover is placed on top of the support rack. The sample (now sandwiched between the rack and cover) is submerged in the water reservoir. After the sample is submerged for 60 seconds, the sample support rack and cover are gently raised out of the reservoir.

The sample, support rack and cover are allowed to drain vertically (at angle greater than 60° but less than 90° from horizontal) for 60±5 seconds, taking care not to excessively shake or vibrate the sample. While the sample is draining, the rack cover is removed and excess water is wiped from the support rack. The wet sample and the support rack are weighed on the previously tared balance. The weight is recorded to the nearest 0.01 g. This is the wet weight of the sample.

The procedure is repeated for with another sample of the fibrous structure, however, the sample is positioned on the support rack such that the sample is rotated 90° in plane compared to the position of the first sample on the support rack.

The gram per fibrous structure sample absorptive capacity of the sample is defined as (wet weight of the sample−dry weight of the sample). The calculated VFS is the average of the absorptive capacities of the two samples of the fibrous structure.

Sled Surface Drying Test Method

The sled surface drying test is performed using constant rate of extension tensile tester with computer interface (a suitable instrument is the MTS Alliance using Testworks 4. Software, as available from MTS Systems Corp., Eden Prairie, Minn.) using a load cell for which the forces measured are within 10% to 90% of the limit of the cell. The instrument is fitted with a coefficient of friction fixture and sled as depicted in ASTM D 1894-01 FIG. 1 *c*. (a suitable fixture is the Coefficient of Friction Fixture and Sled available as #769-3000 from Thwing-Albert, West Berlin, N.J.). The movable (upper) pneumatic jaw is fitted with rubber faced grips, suitable to securely clamp the sled's lead wire. The target surface is a black Formica® brand laminate #909-58 which has a contact angle (water) of 66±5 degrees. All testing is performed in a conditioned room maintained at 23° C.±2° C. and 50%±2% relative humidity. The test area is substantially free from air drafts from doors, ventilation systems, or lab traffic. The target surface at the observation zone is illuminated at 7.5 lumens±0.2 lumens.

Figure 15:
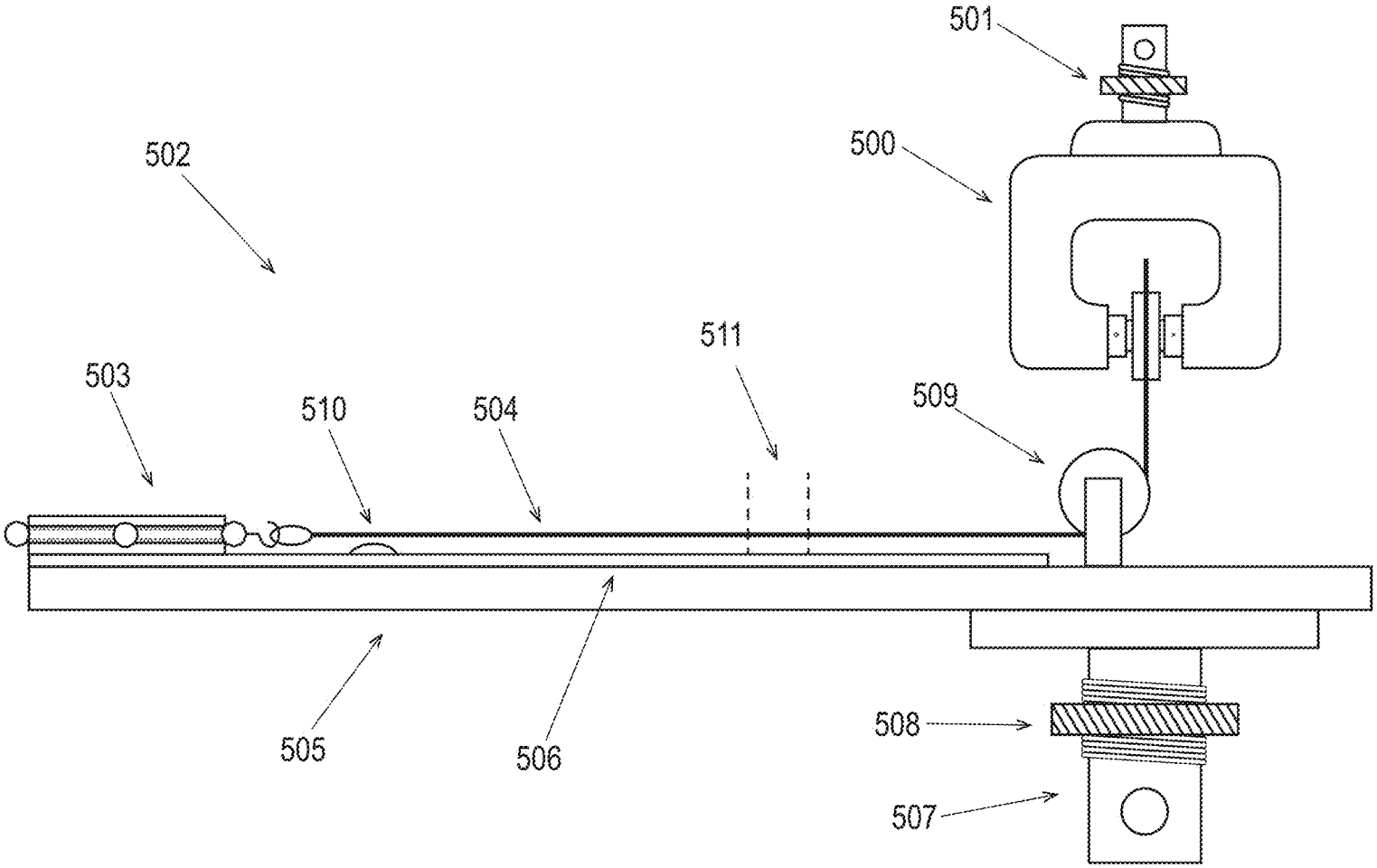
FIG. 15 is a schematic representation of an apparatus used in the Sled Surface Drying Test Method.

Referring to FIG. 15, the lower fixture 502, consist of a stage 505, 40 in long by 6 in wide by 0.25 in thick, mounted via a shaft 507 designed to fit the lower mount of tensile tester. A locking collar 508 is used to stabilize the platform and maintain horizontal alignment. The stage is covered with the Formica target 506 which is 38 in long by 6 in wide by 0.128 in thick. A pulley 509 is attached to the stage 505 which directs the wire lead 504 from the sled 503 into the grip faces of the upper fixture 500. Time is measured using a lab timer capable of measuring to the nearest 0.1 sec. and certified traceable to NIST.

Condition the sample at 23° C.±2° C. and 50%±2% relative humidity for 2 hours prior to testing. Die cut a specimen 127 mm±1 mm long in the machine direction and 64 mm±1 mm wide in the cross direction. Load the specimen onto the sled 503 by feeding the specimen through the spring-loaded bar grips. Once clamped, the specimen is without slack and completely covers the bottom surface of the sled 503. The acceptable weight of the sled plus sample is 200 g±2 g.

Set the position of the tensile tester crosshead such that the centers of the grip faces are approximately 1.5 in above the top of the pulley. Place the distal end of the sled 503 flush with the distal edge of the target surface 506 as shown in FIG. 5. The sled should be centered along the longitudinal center line of the target. Attach the lead wire 504 first to the sled 503 Feed the other end of the wire lead 504 around the pulley 509 and then between the grip faces of the upper fixture. Zero the load cell. Gently pull the lead wire 504 until a force of 20±5 gram force is read on the load cell. Close the grip faces. Program the tensile tester to move the crosshead for 36 in at a rate of 40 in/min.

Clean the Formica target with 2-propanol and allow the surface to dry. With a calibrated pipette, deposit 0.5 mL of distilled water onto the target centered along the longitudinal axis of the target and 8 in from the distal edge of the target. The diameter of the water should not exceed 0.75 in (for convenience a circle 0.75 in in diameter can be marked at the site). Zero the crosshead and the timer. Simultaneously start the timer and begin the test.

After the sled movement has ceased, observe the evaporation of the liquid streak. The observer should monitor a 1 in wide observation zone 511, located between 28 to 29 inches from the distal edge of the target 506, while at an observation angle of approximately 45 degrees from the horizontal plane of the platform 505. The timer is stopped when all signs of the water have disappeared. Record the Sled Surface Drying Time to the nearest 0.1 sec.

Testing is repeated for a total of 20 replicates for each sample. Clean the surface every five specimen or when a new sample is to be tested. The data set can be evaluated using the Grub's T test (Tcrit<90%) for outliers, but no more than 3 replicates can be discarded. If more than 3 outliers exist, a second set of 20 replicates should be tested. Average the replicate samples and report the Sled Surface Drying Time to the nearest 0.1 sec.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A multi-ply fibrous structure comprising a first fibrous structure ply and a second fibrous structure ply bonded together at one or more thermal bond points, wherein each of the first and second fibrous structure plies comprises two or more regions not present within the one or more thermal bond points, wherein the two or more regions exhibit different density values relative to one another, wherein the first and second fibrous structure plies comprise a plurality of filaments comprising a thermoplastic polymer selected from the group consisting of: polypropylene, polyethylene, polyester, polylactic acid, polyhydroxyalkanoate, polycaprolactone, styrene-butadiene-styrene block copolymer, styrene-isoprene-styrene block copolymer, poly-urethane, and mixtures thereof and a plurality of solid additives, wherein the multi-ply fibrous structure comprises one or more z-direction void volumes of at least 20 μm between the first and second fibrous structure plies.

2. The multi-ply fibrous structure according to claim 1 wherein the solid additives comprise a wood pulp fiber selected from the group consisting of: Southern Softwood Kraft pulp fibers, Northern Softwood Kraft pulp fibers, Eucalyptus pulp fibers, Acacia pulp fibers.

3. The multi-ply fibrous structure according to claim 1 wherein the multi-ply fibrous structure further comprises a polysaccharide filament.

4. The multi-ply fibrous structure according to claim 3 wherein the polysaccharide filament comprises a polysaccharide selected from the group consisting of: starch, starch derivatives, cellulose, cellulose derivatives, hemicellulose, hemicellulose derivatives and mixtures thereof.

5. The multi-ply fibrous structure according to claim 1 wherein at least one surface of the one or more first and second fibrous structure plies of the multi-ply fibrous structure consists of a layer of filaments.

6. The multi-ply fibrous structure according to claim 1 wherein at least one of the first and second fibrous structure plies of the multi-ply fibrous structure comprises a scrim material.

7. The multi-ply fibrous structure according to claim 1 wherein the multi-ply fibrous structure comprises at least a bi-modal pore volume distribution.

8. The multi-ply fibrous structure according to claim 1 wherein at least one of the first and second fibrous structure plies of the multi-ply fibrous structure comprises undulations.

9. The multi-ply fibrous structure according to claim 1 wherein at least one of the first and second fibrous structure plies of the multi-ply fibrous structure comprises a creped fibrous structure.

10. The multi-ply fibrous structure according to claim 1 wherein at least one ply of the multi-ply fibrous structure comprises an uncreped fibrous structure.

11. The multi-ply fibrous structure according to claim 1 wherein at least one of the first and second fibrous structure plies of the multi-ply fibrous structure comprises a foreshortened fibrous structure.

12. The multi-ply fibrous structure according to claim 1 wherein the filaments comprise microfilaments.

13. The multi-ply fibrous structure according to claim 1 wherein the multi-ply fibrous structure is convolutedly wound upon itself in the form of a roll.

14. A sanitary tissue product comprising a multi-ply fibrous structure according to claim 1.

15. The sanitary tissue product according to claim 14 wherein the sanitary tissue product is selected from the group consisting of: paper towels, bath tissue, facial tissue, napkins, baby wipes, adult wipes, wet wipes, cleaning wipes, polishing wipes, cosmetic wipes, car care wipes, wipes that comprise an active agent for performing a particular function, cleaning substrates for use with implements and mixtures thereof.

16. The multi-ply fibrous structure according to claim 1 wherein the multi-ply fibrous structure exhibits a pore volume distribution such that at least 2% to less than 40% of the total pore volume present in the multi-ply fibrous structure exists in pores of radii of from 91 μm to 140 μm as measured by the Pore Volume Distribution Test Method.

17. The multi-ply fibrous structure according to claim 1 wherein the non-thermal bond point comprises a z-direction void volume of at least 50 μm between the first and second fibrous structure plies.

18. The multi-ply fibrous structure according to claim 1 wherein the first and second fibrous structure plies exhibit a pore volume distribution such that greater than 8% of the total pore volume present in the fibrous structure ply exists in pores of radii of from 2.5 μm to 50 μm as measured by the Pore Volume Distribution Test Method.

* * * * *